US007558376B2

(12) United States Patent
Anno

(10) Patent No.: US 7,558,376 B2
(45) Date of Patent: Jul. 7, 2009

(54) ROTATING ANODE X-RAY TUBE ASSEMBLY

(75) Inventor: Hidero Anno, Otawara (JP)

(73) Assignees: Kabushiki Kaisha Toshiba, Tokyo (JP); Toshiba Electron Tubes & Devices Co., Ltd., Tochigi-ken (JP)

( * ) Notice: Subject to any disclaimer, the term of this patent is extended or adjusted under 35 U.S.C. 154(b) by 0 days.

(21) Appl. No.: 11/898,564

(22) Filed: Sep. 13, 2007

(65) Prior Publication Data

US 2008/0080672 A1 Apr. 3, 2008

(30) Foreign Application Priority Data

Sep. 29, 2006 (JP) ..... 2006-269314
Jul. 31, 2007 (JP) ..... 2007-199965

(51) Int. Cl.
*H01J 35/10* (2006.01)

(52) U.S. Cl. ..... 378/130; 378/125

(58) Field of Classification Search ..... 378/119–144
See application file for complete search history.

(56) References Cited

U.S. PATENT DOCUMENTS 4,993,055 A * 2/1991 Rand et al. ..... 378/125
5,509,045 A * 4/1996 Kautz ..... 378/123
5,581,591 A * 12/1996 Burke et al. ..... 378/135
5,703,926 A 12/1997 Bischof
6,364,527 B1 * 4/2002 Kutschera ..... 378/200
6,396,901 B1 * 5/2002 Hell et al. ..... 378/130
7,382,865 B2 * 6/2008 Deutscher et al. ..... 378/144
2002/0146092 A1 * 10/2002 Richardson et al. ..... 378/130
2004/0264645 A1 12/2004 Freudenberger et al.
2006/0182222 A1 * 8/2006 Anno et al. ..... 378/130

FOREIGN PATENT DOCUMENTS

| | | |
|---|---|---|
| FR | 2 599 555 | 12/1987 |
| JP | 5-27205 | 4/1993 |
| JP | 2539193 | 7/1996 |
| JP | 2929506 | 5/1999 |
| JP | 2006-054181 | 2/2006 |

OTHER PUBLICATIONS

European Office Action dated Jan. 14, 2008 for Appln. No. 07116920.5-2208.

* cited by examiner

*Primary Examiner*—Hoon Song
(74) *Attorney, Agent, or Firm*—Pillsbury Winthrop Shaw Pittman, LLP

(57) ABSTRACT

There is disclosed a rotating anode X-ray tube assembly includes a vacuum envelope integrated with an anode target, a housing receiving at least the vacuum envelope, and rotatably holding it, a circulation path circulating a cooling medium in a state of closing to at least anode target of the vacuum envelope, a cathode received and arranged in the vacuum envelope, a cathode support member supporting the cathode, a bearing mechanism and a vacuum sealing mechanism interposed between the vacuum envelope, and the housing or a stationary member direct or indirectly fixed to the housing, and a driver unit for rotating the vacuum envelope.

26 Claims, 19 Drawing Sheets

ROTATING ANODE X-RAY TUBE ASSEMBLY

CROSS-REFERENCE TO RELATED APPLICATIONS

This application is based upon and claims the benefit of priority from prior Japanese Patent Applications No. 2006-269314, filed Sep. 29, 2006; and No. 2007-199965, filed Jul. 31, 2007, the entire contents of both of which are incorporated herein by reference.

BACKGROUND OF THE INVENTION

1. Field of the Invention

The present invention relates to a rotating anode X-ray tube assembly. In particular, the present invention relates to a structure for improving the heat dissipation characteristics of an anode.

2. Description of the Related Art

A conventional rotating anode X-ray tube assembly for improving the heat dissipation characteristics of an anode is largely classified into the following two types.

(1) Type 1: A rotating anode X-ray tube assembly includes a rotating anode X-ray tube and a housing, etc. The rotating anode X-ray tube is provided to receiving a rotatably supported anode target in a vacuum envelope. The housing is provided to receive a rotary anode X-ray tube. In order to remove the heat of the anode target, a circulation path for circulating a cooling medium in the anode target is provided (e.g., see Jpn. Pat. Appln. KOKOKU Publication No. H5-27205 and Jpn. Pat. Appln. KOKAI Publication No. 2006-54181).

The heat of the anode target is conducted to a cooling medium via a short thermal path. Therefore, the heat dissipation characteristics of the anode is improved.

(2) Type 2: A rotating anode X-ray tube assembly including the following components:

One is a vacuum chamber, that is, a vacuum envelope rotatable around the axis line, and given an anode target as its part. Another is means for rotating the vacuum envelope around the axis line. Another is a cathode generating electrons, attached in the vacuum envelope, and a deflection coil arranged out of the vacuum envelope to deflect the electrons into an area out of the axis line of the anode target. Another is a slip ring mechanism for supplying current to the cathode via a wall portion of the vacuum envelope from an external source of the vacuum envelope (e.g., see Japanese Patent No. 2539193, French Patent Application No. 2599555-A1, Japanese Patent No. 2929506 and U.S. Pat. No. 6,396,901).

The heat of the anode target is conducted to a cooling medium via a short thermal path. Therefore, the heat dissipation characteristics of the anode is improved.

The rotating anode X-ray tube assembly having the foregoing structure (1) has the following problem. Specifically, if the thermal load of the rotating anode X-ray tube becomes large, required cooling performance is not sufficiently obtained for the following reasons.

A) The difference (relative moving speed) between a moving speed of the backside of the rotating anode target and that of fluid contacting with the backside is high. In this case, the thermal conductivity at the contact interface increases. However, in the case of the foregoing (1) structure, the relative moving speed does not so depend on a rotating speed of the anode target, and almost depends on a fluid speed of the cooling medium only. This is because the cooling medium rotates together with a rotation of the anode target (the case of Jpn. Pat. Appln. KOKAI Publication 2006-54181).

B) The cooling medium is forcedly supplied by a circulating pump via the inside of a thin shaft having a high fluid resistance and a narrow path provided in the target. For this reason, there is a limit to improving the fluid speed of the cooling medium.

C) According to the structure in which a flow path is provided in the anode target, the manufacturing cost increases resulting from its complication. Conversely, according to the structure shown in FIG. 5 of Jpn. Pat. Appln. KOKAI Publication 2006-54181, no flow path is provided in the anode target. However, the foregoing simple anode target structure is employed, and thereby, cooling performance is further reduced.

The rotating anode X-ray tube assembly having the foregoing (2) structure has the following problem like the rotating anode X-ray tube assembly having the foregoing structure (1). Specifically, if the thermal load of the rotating anode X-ray tube becomes large, the required cooling performance is not sufficiently obtained for the following reasons.

D) First, it is difficult to use a water cooling medium having high cooling performance. Insulation oil having low cooling performance must be used as the cooling medium. In other words, a space where the cooling medium exists and a cathode potential exposed space communicate with each other. For this reason, if the water cooling medium is used, breakdown voltage of the cathode is reduced resulting from an influence of water vapor.

E) The following structure is given; specifically, there is provided a slip ring mechanism for supplying current to the cathode via a wall portion of the vacuum envelope from an external source of the vacuum envelope. Resulting from the foregoing structure, it is difficult to realize highgrade functions such as multiple focus or a pulsed operation in addition of a grid electrode. This is because many slip ring mechanisms must be provided in accordance with the highgrade functions. As a result, one or more slip ring mechanisms must be provided at a portion having high circumferential speed out of the axial line. Such a case, the lifetime of the slip ring mechanism is shortened due to abrasion of the sliding parts.

BRIEF SUMMARY OF THE INVENTION

An object of the present invention is to provide a rotating anode X-ray tube assembly, which can improve the heat dissipation characteristics of an anode, and has high reliability over the long term.

To achieve the object, according to one aspect of the present invention, there is provided a rotating anode X-ray tube assembly comprising:

a vacuum envelope integrated with an anode target;

a housing receiving at least the vacuum envelope, and rotatably holding it;

a circulation path circulating a cooling medium in a state of closing to at least anode target of the vacuum envelope;

a cathode received and arranged in the vacuum envelope;

a cathode support member supporting the cathode;

a bearing mechanism and a vacuum sealing mechanism interposed between the vacuum envelope, and the housing or a stationary member direct or indirectly fixed to the housing; and a driver unit for rotating the vacuum envelope.

According to another aspect of the present invention, there is provided a rotating anode X-ray tube assembly comprising:

an anode target generating X-rays by collision with electrons;

an electron emission source emitting electrons;

a vacuum container integrated with the anode target, and holding the anode target and the electron emission source under a predetermined low pressure;

a housing receiving the vacuum container and a cooling liquid, so that a cooling liquid is circulated between the vacuum container and the housing;

a support member fixing the electron emission source to the housing;

a holder member rotatably holding the vacuum container in the housing; and a vacuum sealing member positioned between the vacuum container and the holder member, so that the vacuum container is rotating in the housing while maintaining the vacuum inside the vacuum container.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be hereinafter described in detail with reference to the accompanying drawings.

Figure 1:
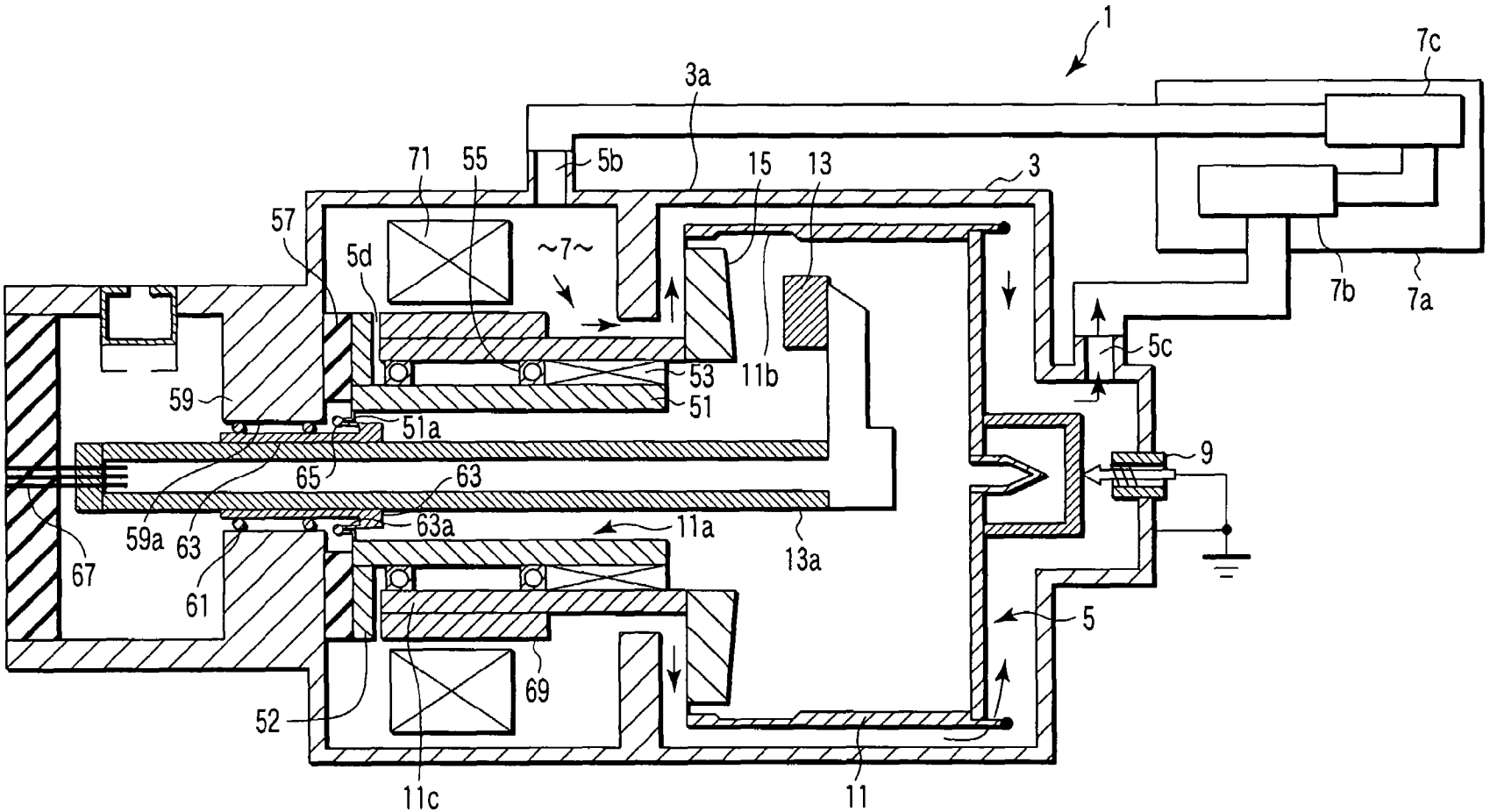
FIG. 1 is a view schematically showing a rotating anode X-ray tube assembly according to one embodiment of the invention.

As shown in FIG. 1, an X-ray tube assembly 1 is built into an X-ray image diagnostic apparatus and a non-destructive tester, for example. The X-ray tube assembly 1 radiates X-rays to an object, that is, test target. The X-ray tube assembly 1 has a housing 3 and an X-ray tube body (rotary anode X-ray tube) 5. The X-ray tube body 5 is received in the housing 3, and radiates X-rays having a predetermined strength to a predetermined direction.

The X-ray tube body 5 is received in a predetermined position of the housing 3 via a coolant 7. The coolant 7 consists of mainly water, for example, and is non-oil cooling liquid (water-based cooling medium) having an electrical conductivity of less than a predetermined value. A cooling medium having an electric conductivity of less than 1 mS/m is used as the coolant 7 to secure low-voltage insulation characteristics and to reduce corrosion to metallic components. Moreover, the following glycol is given as the cooling medium mixing with water. For example, ethylene glycol and propylene glycol are usable.

The X-ray tube body 5 includes a vacuum envelope 11, a cathode electron gun (thermally activated electron emission source) 13 and a rotating anode (anode target, anode) 15. The vacuum envelope 11 is rotatably located so that its entire circumference generally contacts the coolant (water cooling medium) 7 contained in the housing 3. The inside of the vacuum envelope 11 is kept at a predetermined degree of vacuum. The cathode electron gun 13 is provided within and independently of the vacuum envelope 11. The anode target 15 is located integrally with the vacuum envelope 11 in the vacuum envelope 11. Electrons emitted from the electron gun 13 are accelerated by the electric field between the cathode 13 and the anode target 15, and collide with the anode target 15, and thereby, the anode target 15 radiates X-rays having a predetermined wavelength. Incidentally, the vacuum envelope 11 contacts with a ground pole 9 penetrating through a predetermined position of one end of the housing 3, and thus, grounded.

The vacuum envelope 11 is held by a magnetic fluid vacuum sealing member 53 and a bearing (rolling bearing, ball/roll bearing) member 55. The magnetic fluid vacuum sealing member 53 is located at a predetermined position at the outer peripheral surface of a cylindrical stationary portion 51 provided at a predetermined position of the housing 3. The bearing member 55 is located at a predetermined position of the stationary portion 51, that is, on the side close to a flow path of the coolant 7 from the magnetic fluid vacuum sealing member 53. The cylindrical stationary portion 51 is fixed to a vacuum envelope holder 59 via an electrical insulating support member 57. The stationary portion 51 and the vacuum envelope holder 59 are concentrically (coaxially) located.

The cathode electron gun 13 is fixed to a cylindrical and electrical insulating cathode holder 13*a*. A fixing member 63 fixed to the outer peripheral surface of the cathode holder 13*a* and a predetermined area inside a cylinder 59*a* of the vacuum envelope holder 59 are fixed via a sealing member 61. As described above, the cathode electron gun 13 is fixed at a predetermined position inside the vacuum envelope 11.

The fixing member 63 has an end portion 63*a* at the side separating from the fixed to the sealing member 61. A connection structural member 51*a* is connected with the cylindrical stationary portion 51, and has a spring characteristic. The stationary portion 51 supports the vacuum envelope 11 from the inner side of the vacuum envelope 11. The end portion 63*a* is connected (fixed) by the connection structural member 51*a* and a welding portion 65. The cathode holder 13*a* of the cathode electron gun 13 has a predetermined length penetrating through the vacuum envelope holder 59 of the housing 3. The cathode holder 13*a* is electrically connected with a connector (high-voltage supply terminal) 67 on the side opposite to the side where the ground pole 9 of the housing 3 is provided. The connector (high-voltage supply terminal) 67 is used for supplying power to the cathode electron gun.

The end portion 63*a* of the stationary member 63 and the connection structural member 51*a* are fixed by the welding portion 65. In this way, when the vacuum envelope 11 is rotated, this serves to prevent vibration from being transmitted to the cathode electron gun 13. Specifically, the connection structural member 51*a* has a spring characteristics; therefore, vibration generated by a rotation of the vacuum envelope 11 is absorbed. In addition, due to the spring characteristics of the connection structural member 51*a*, a slight assembly error is offset between the cathode holder 13*a* and the cylindrical stationary portion 51.

A plurality of permanent magnets 69 is provided at a predetermined position of the vacuum envelope on the side holding the anode (anode target) 15. The permanent magnets 69 are provided near a bearing 11*a* of the vacuum envelope positioning outside the bearing member 55. The permanent magnets 69 receive thrust (magnetic force) for rotating the vacuum envelope 11.

A stator 71 is provided at a predetermined position of the housing 3 coaxial (concentric) with the permanent magnets 69. The stator 71 provides a magnetic force (thrust) with respect to the permanent magnets 69 at arbitrary timing. The stator 71 is a coil member, and is controlled to form a rotating magnetic field.

In the X-ray tube assembly 1, a predetermined current is supplied to the stator 71. In this way, the vacuum envelope 11 is rotated at a predetermined speed. Thus, the anode target (rotary anode) 15 provided in the vacuum envelope 11 is rotated at a predetermined speed. In this state, electrons emitted from the cathode electron gun 13 collide with the anode target 15. In this way, X-rays having a predetermined wavelength are output from the anode target 15. The output X-rays are radiated outside from windows 11*b* and 3*a*. The window 11*b* is located at a predetermined position of a cylindrical portion of the vacuum envelope 11. The window 3*a* is located at a predetermined position of a cylindrical portion of the housing 3.

The coolant 7 is injected between most of areas on the outside of the vacuum envelope and internal predetermined areas of the housing 3 via a cooling liquid inlet 5*b*. The cooling liquid inlet 5*b* is located in the vicinity of the bearing portion 11*a* of the vacuum envelope 11. The coolant 7 is discharged from a cooling liquid outlet 5*c* formed near the ground pole 9 outside the housing 3. In this way, the bearing portion 11*a* and the anode target 15 built into the vacuum envelope 11 are cooled.

The inside of the vacuum envelope 11, that is, the cathode electron gun 13 and the anode target 15 is kept at a predetermined vacuum state by the magnetic fluid vacuum sealing member 53. The magnetic fluid vacuum sealing member has been reported by the following document, for example.

Document: Kamiyama, "Lubrication", vol. 30, No. 8, pp 75 to 78

In order to form the foregoing magnetic fluid vacuum sealing member, the following preparation is required. A predetermined amount of magnetic fluid is prepared at the outer periphery of an axis structure body covering a magnetic or non-magnetic axis with a cylinder comprising magnetic fluid. In this case, the magnetic fluid is a colloid solution dispersing ferromagnetic particles in liquid. A magnetic piece and permanent magnet are close to the axis or the axis structural body to form a magnetic circuit. In this way, the magnetic fluid stays around the axis or the axis structural body. The magnetic fluid vacuum sealing member is a sealing member for maintaining a pressure (atmospheric pressure) difference. The use of the magnetic fluid vacuum sealing member is effective for keeping the vacuum envelope 11 at a predetermined vacuum (low pressure).

The coolant 7 supplied into the housing 3 is cooled by a heat exchanger 7*b* located in a cooler unit 7*a*. The coolant 7 is circulated between the cooling liquid inlet 5*b* and the cooling liquid outlet 5*c* by a pump 7*c*. In this way, heat generated in the anode target 15 and the bearing portion 11*a* is released outside the housing via the coolant 7.

In this case, the coolant 7 flows near the magnetic fluid vacuum sealing member 53 and the backside of the anode target 15 via the vacuum envelope 11. Thus, the magnetic fluid vacuum sealing member 53 and the anode target 15 are effectively cooled. The flow path of the coolant 7 is formed by designing a shape of the housing 3 and the X-ray tube body 5. The flow path of the coolant 7 is suitably designed, and thereby, the coolant 7 can cool the stator 71 together. Most of heat generated by the X-ray tube assembly 1 is released outside the X-ray tube assembly 1 via the coolant 7.

The end portion 11*c* of the vacuum envelope 11 is positioned at one end portion of thereof, and close to the stationary portion 51 of the housing 3. The end portion 11*c* serves to provide a slight clearance between a projected portion 52 of the stationary portion 51 and the end portion, that is, clearance 5*d* having low wettability. Thus, the clearance 5*d* prevent the coolant 7 from coming into the vacuum envelope 11. In this way, the coolant 7 reaches the magnetic fluid vacuum sealing member 53; therefore, the performance (ability) of the vacuum sealing member 53 is prevented from undesirably reducing.

According to this embodiment, water mixed with glycol is used as the cooling medium. In this case, in order to make the contact angle large, the end portion 11*c* (including end portion of the permanent magnet 69) of the vacuum envelope 11 and the stationary portion 51 are preferably coated with a resin.

Of the bearing member 55, a bearing member separating from the magnetic fluid vacuum sealing member 53 is a seal type sealed between inner and outer cylinders by a sealing member. This serves to prevent coolant 7 from coming into the magnetic fluid vacuum sealing member 53.

As described above, one embodiment of the invention is applied to the X-ray tube assembly. In this way, the heat dissipation characteristics is improved by means of the water-based cooling medium. Thus, stable long-term characteristics are secured. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Figure 2:
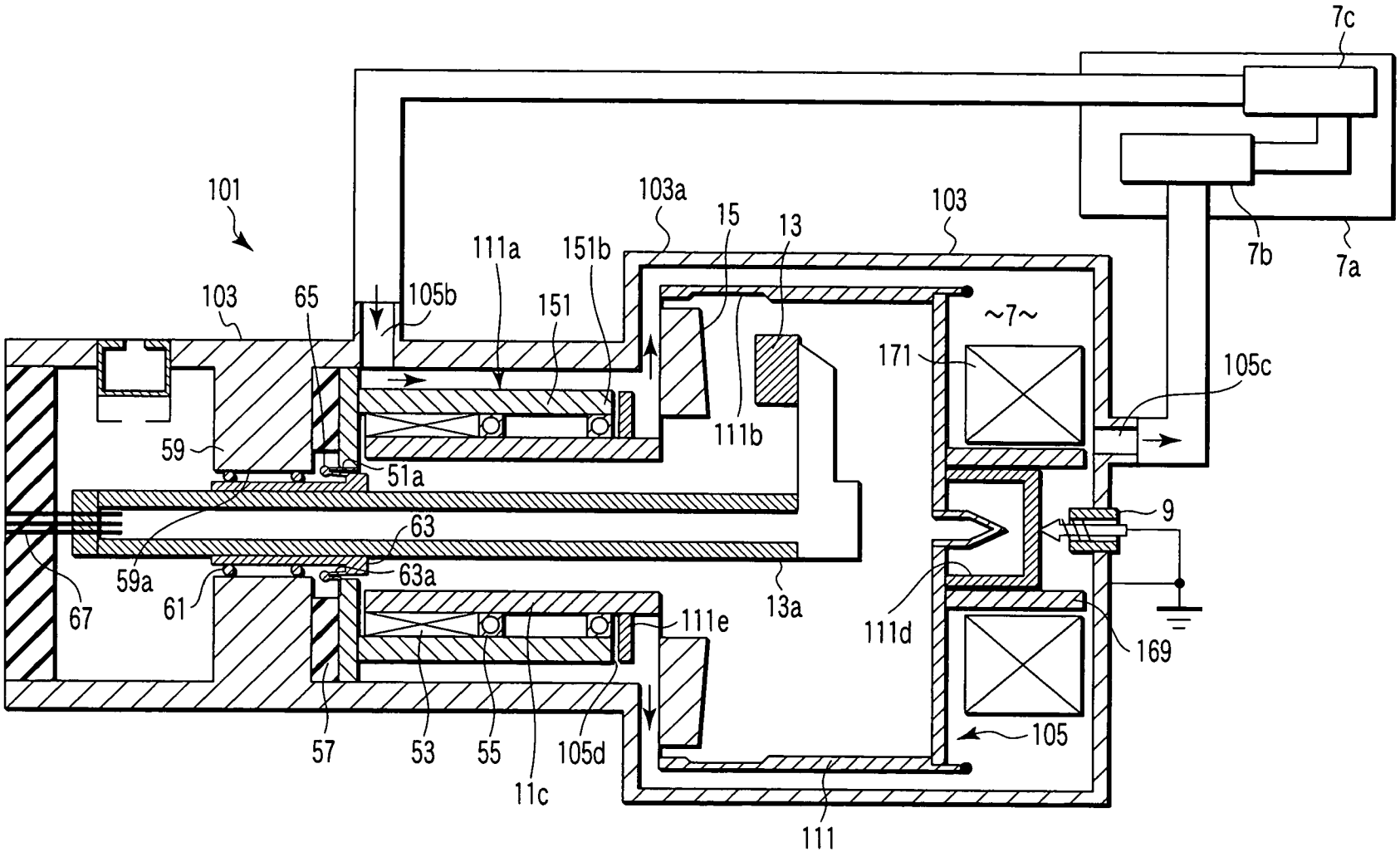
FIG. 2 is a view schematically showing a rotating anode X-ray tube assembly according to one embodiment of the invention.

FIG. 2 relates to another embodiment of an X-ray tube assembly of the present invention. The same reference numbers are used to designate the same members as already described in FIG. 1, and the details are omitted. A reference number adding 100 is given to members similar to members as already described in FIG. 1, and the details are omitted.

An X-ray tube assembly 101 shown in FIG. 2 has a housing 103, and an X-ray tube body (rotating anode X-ray tube) 105 received in the housing 103.

The X-ray tube body 105 is received at a predetermined position in the housing 103 via a coolant 7. The coolant 7 consists of mainly water, and water-based cooling medium (non-oil cooling medium) having a conductivity of less than 1 mS/m.

A vacuum envelope 111 contacts with a ground pole 9 penetrating through a predetermined position of one end of the housing 103 to be grounded.

The inside of the vacuum envelope 111 is kept at a predetermined degree of vacuum. The vacuum envelope 111 is provided with a cathode electron gun (thermally activated electron emission source) 13, and a rotating anode (anode target, anode) 15. The cathode electron gun 13 is provided independently from the vacuum envelope 111. The anode target 15 is located integrally with the vacuum envelope 111 inside the vacuum envelope 111. Electrons emitted from the electron gun 13 collide with the anode target 15, and thereby, the anode target 15 radiates X-rays having a predetermined wavelength.

The vacuum envelope 111 is held by a magnetic fluid vacuum sealing member 53 and a bearing (rolling bearing, ball/roll bearing) member 55. The magnetic fluid vacuum sealing member 53 is located at a predetermined position at the outer peripheral surface of a cylindrical stationary portion 151 provided at a predetermined position of the housing 103. The bearing member 55 is located at a predetermined position of the stationary portion 151, that is, on the side close to a flow path of the coolant 7 from the magnetic fluid vacuum sealing member 53. The cylindrical stationary portion 151 is fixed to a vacuum envelope holder 59 via an electrical insulating support member 57. The stationary portion 151 and the vacuum envelope holder 59 are concentrically (coaxially) fixed to a vacuum envelope holder 59 of the housing 103 via support member 57.

The cathode electron gun 13 is fixed to a cylindrical and electrical insulating cathode holder 13*a*. A fixing member 63 fixed to the outer peripheral surface of the cathode holder 13*a* and a predetermined area inside a cylinder 59*a* of the vacuum envelope holder 59 are fixed via a sealing member 61. As described above, the cathode electron gun 13 is fixed at a predetermined position inside the vacuum envelope 111.

The fixing member 63 has an end portion 63*a* at the side separating from the fixed to the sealing member 61. A connection structural member 51*a* is connected with the cylindrical stationary portion 51, and has a spring characteristic. The stationary portion 151 supports the vacuum envelope 111 from the outer side of the vacuum envelope 111. The end portion 63*a* is connected (fixed) by the connection structural member 51*a* and a welding portion 65.

The cathode holder 13*a* of the cathode electron gun 13 has a predetermined length penetrating through the vacuum envelope holder 59 of the housing 103. The cathode holder 13*a* is electrically connected with a connector (high-voltage supply terminal) 67 on the side opposite to the side where the ground pole 9 of the housing 103 is provided. The connector (high-voltage supply terminal) 67 is used for supplying power to the cathode electron gun.

The end portion 63*a* of the stationary member 63 and the connection structural member 51*a* are fixed by the welding portion 65. In this way, when the vacuum envelope 111 is rotated, this serves to prevent vibration from being transmitted to the cathode electron gun 13. Specifically, the connection structural member 51*a* has a spring characteristic; therefore, vibration generated by a rotation of the vacuum envelope 111 is absorbed.

A plurality of permanent magnets 169 is provided at a predetermined position of the vacuum envelope 111 holding the anode (anode target) 15. The permanent magnets 169 are located near the ground pole 9 and at the following portion (hereinafter, referred to as distal end) 111*d*. The portion 111*d* is smaller than the outer diameter of the vacuum envelope 111 surrounding the anode target 15. The permanent magnets 169 receive thrust (magnetic force) for rotating the vacuum envelope 111.

A predetermined position of the housing 103 is provided with a stator coil 171. The stator coil 171 is located coaxially (concentrically) with the permanent magnets 169. The permanent magnets 169 are located to surround the distal end 111*d* of the vacuum envelope 111. The stator coil 171 provides a magnetic force (thrust) to the permanent magnets 169 at an arbitrary timing. The stator coil 171 is formed as an electromagnet so that its rotation is controllable from the outside.

In the X-ray tube assembly 101, a predetermined current is supplied to the stator 171. In this way, the vacuum envelope 111 is rotated at a predetermined speed. Thus, the anode target (rotating anode) 15 provided in the vacuum envelope 111 is rotated at a predetermined speed. In this state, electrons emitted from the cathode electron gun 13 collide with the anode target 15. In this way, X-rays having a predetermined wavelength are output from the anode target 15. The output X-rays are radiated outside from windows 111*b* and 103*a*. The window 111*b* is located at a predetermined position of a cylindrical portion of the vacuum envelope 111. The window 103*a* is located at a predetermined position of a cylindrical portion of the housing 103.

The coolant 7 is injected into the housing 103 via a cooling liquid inlet 105*b* provided near a bearing portion 111*a* of the vacuum envelope 111. The coolant 7 is discharged from a cooling liquid outlet 105*c* provided in the vicinity of the ground pole 9. The coolant 7 is circulated between most of outside areas of the vacuum envelope 111 and internally predetermined areas of the housing 103. Thus, the magnetic fluid vacuum sealing member 53 and the anode target 15 built into the vacuum envelope 111 are cooled.

The coolant 7 supplied into the housing 103 is cooled by a heat exchanger 7*b* provided in a cooler unit 7*a*. The coolant 7 is circulated between the cooling liquid inlet 105*b* and the cooling liquid outlet 105*c* by a pump 7*c*. In this way, heat generated in the X-ray tube assembly 101 is released outside the housing 103 using the coolant 7 as a cooling medium.

As described above, the coolant 7 serves to efficiently cool the magnetic fluid vacuum sealing member 53 and the anode target 15. The flow path of the coolant 7 is designed to contact with the stationary portion 151 formed of metal, in general.

A predetermined position of the vacuum envelope 111 is provided with a flange 111*e* for reducing wettability. The flange 111*e* for reducing wettability is located in the vicinity of the anode target 15 of the vacuum envelope closing to one end portion 151*b* of the stationary portion 151 of the housing 103. The flange 111*e* for reducing wettability is provided integrally with an end portion 11*c*. The flange ille for reducing wettability serves to prevent the coolant 7 from coming into the bearing member 55 and the magnetic fluid vacuum sealing member 53.

A small clearance, that is, low wettability clearance 105*d* is formed between the flange 111*e* for reducing wettability and one end portion 151*b* of the stationary portion 151. Thus, the flange 111*e* for reducing wettability and one end portion 151*b* prevent the coolant 7 from coming into the inside of the vacuum envelope 111. In this way, it is possible to prevent the coolant from coming into the magnetic fluid vacuum sealing member 53. This serves to prevent the performance (ability) of the vacuum sealing member 53 from being undesirably reduced.

If the coolant 7 given as liquid having a relatively large contact angle is used as a cooling medium, the clearance 105*d* having low wettability is set smaller than a predetermined value. In this way, the coolant is prevented from coming into the clearance 105*d*. According to this embodiment, medium mixing water or glycol is used as the cooling medium. In this case, in order to make the contact angle large, the flange 111*e* of the vacuum envelope 111 and one end portion 151*b* of the stationary portion 151 are preferably coated with a resin.

Of the bearing member 55, a bearing member separating from the magnetic fluid vacuum sealing member 53 is a seal type. This serves to further prevent coolant 7 from coming into the magnetic fluid vacuum sealing member 53.

As described above, one embodiment of the invention is applied to the X-ray tube assembly. In this way, the heat dissipation characteristics is improved by means of the water cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Figure 3:
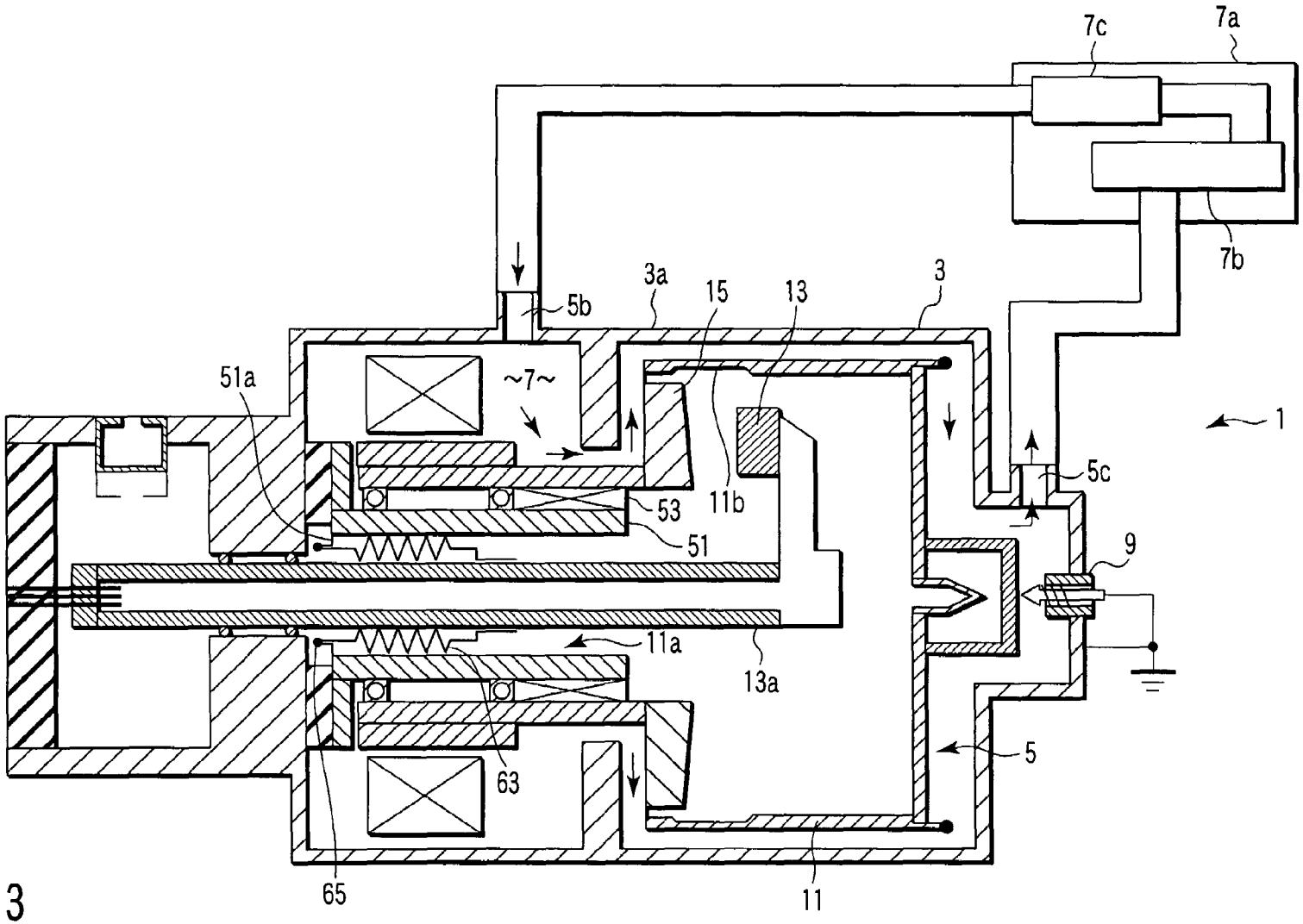
FIG. 3 is a view schematically showing a rotating anode X-ray tube assembly according to one embodiment of the invention.
Figure 4:
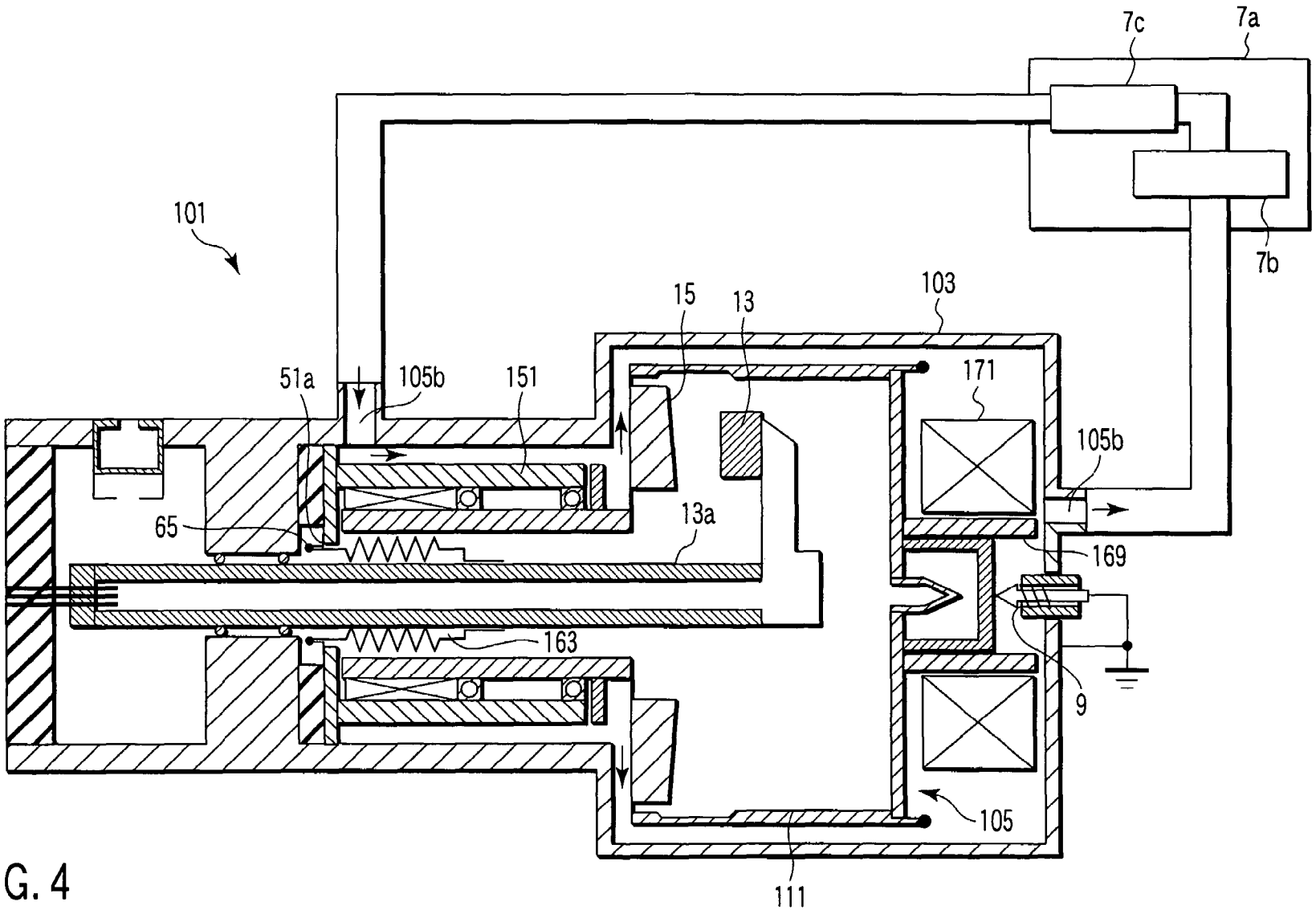
FIG. 4 is a view schematically showing a rotating anode X-ray tube assembly according to one embodiment of the invention.

In the X-ray tube assembly 1 shown in FIG. 3 or the X-ray tube assembly 101 show in FIG. 4, the stationary member 63 (163 in FIG. 4) welded with the connection structural member 51*a* by welding portion 65 has a bellows cylindrical shape. In this way, vibration of the rotating vacuum envelope 11 (111 in FIG. 4) is prevented from being undesirably transmitted to the cathode electron gun 13.

A large assembly error of the cathode holder 13*a* and the cylindrical stationary portion 51 or stationary portion 151 is absorbed.

Figure 5:
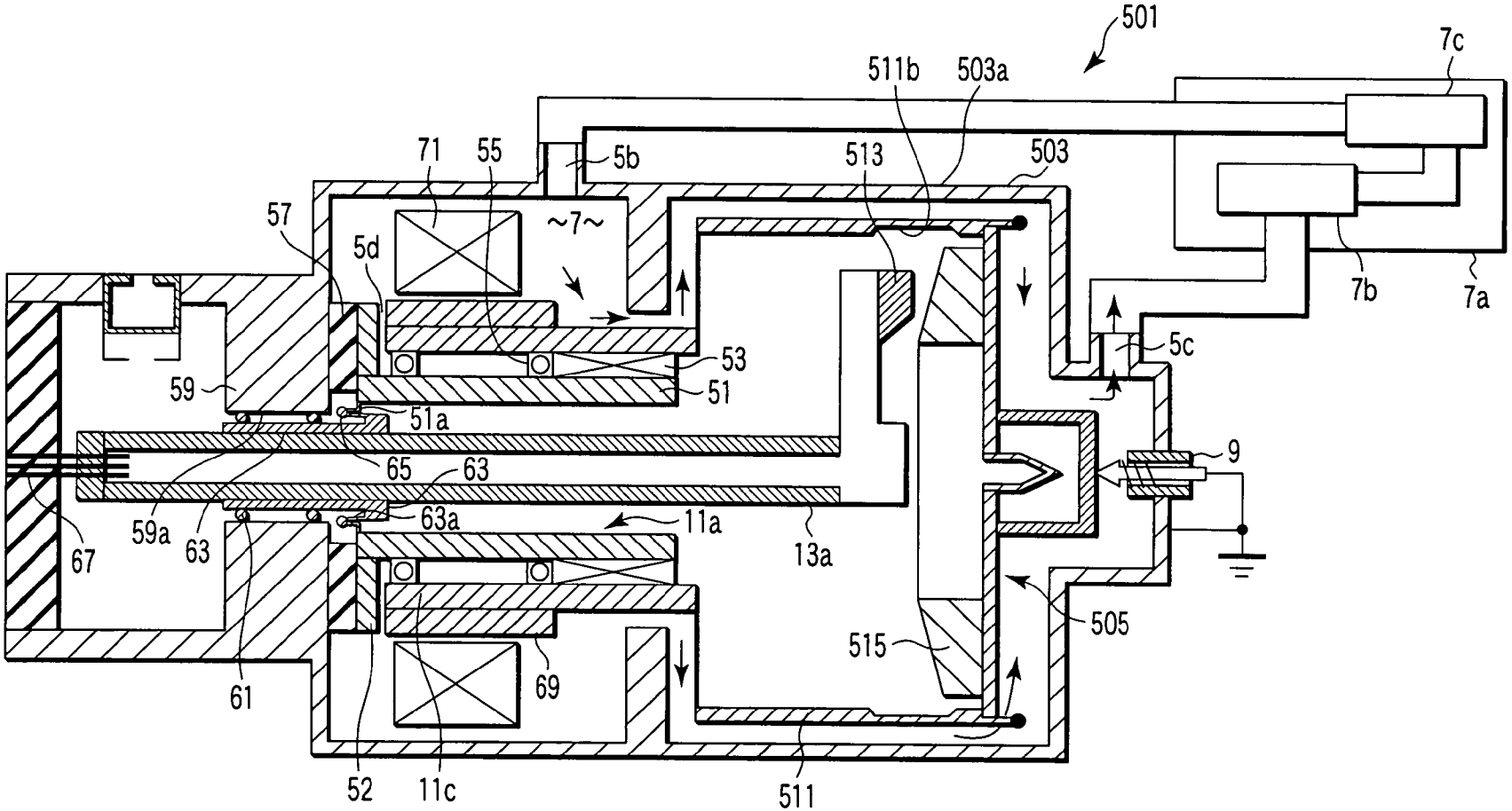
FIG. 5 is a view schematically showing a rotating anode X-ray tube assembly according to one embodiment of the invention.

FIG. 5 relates to still another embodiment of the X-ray tube assembly of the present invention. The same reference numbers are used to designate the same members as already described in FIG. 1, and the details are omitted. A reference number adding 500 is given to members similar to members as already described in FIG. 1, and the details are omitted.

An X-ray tube assembly 501 shown in FIG. 5 has a housing 503, and an X-ray tube body (rotating anode X-ray tube) 505 received in the housing 503.

The X-ray tube body 505 is received at a predetermined position in the housing 503 via a coolant 7. The coolant 7 consists of mainly water, and water-based cooling medium (non-oil cooling medium) having a conductivity of less than 1 mS/m.

A vacuum envelope 511 contacts with a ground pole 9 penetrating through a predetermined position of one end of the housing 503 to be grounded.

The inside of the vacuum envelope 511 is kept at a predetermined degree of vacuum. The vacuum envelope 511 is provided with a cathode electron gun (thermally activated electron emission source) 513, and a rotating anode (anode target, anode) 515. The cathode electron gun 513 is provided independently from the vacuum 511. The anode target 515 is located integrally with the vacuum envelope 511 at the side close to the ground pole 9 of the housing 503. Electrons emitted from the electron gun 513 collide with the anode target 515, and thereby, the anode target 515 radiates X-rays having a predetermined wavelength.

The vacuum envelope 511 is held by a magnetic fluid vacuum sealing member 53 and a bearing (rolling bearing, ball/roll bearing) member 55. The magnetic fluid vacuum sealing member 53 is located at a predetermined position at the outer peripheral surface of a cylindrical stationary portion 51 provided at a predetermined position of the housing 503. The bearing member 55 is located at a predetermined position of the stationary portion 51, that is, on the side close to a flow path of the coolant 7 from the magnetic fluid vacuum sealing member 53. The cylindrical stationary portion 51 is fixed to a vacuum envelope holder 59 of the housing 503 via an electrical insulating support member 57. The stationary portion 51 and the vacuum envelope holder 59 are concentrically (coaxially) located.

The cathode electron gun 513 is fixed to a cylindrical and electrical insulating cathode holder 13*a*. A fixing member 63 fixed to the outer peripheral surface of the cathode holder 13*a* and a predetermined area inside a cylinder 59*a* of the vacuum envelope holder 59 are fixed via a sealing member 61. As described above, the cathode electron gun 513 is fixed at a predetermined position inside the vacuum envelope 511.

The fixing member 63 has an end portion 63*a* at the side separating from the fixed to the sealing member 61. A connection structural member 51*a* is connected with the cylindrical stationary portion 51 (supporting the vacuum envelope 511 from the inner side of the vacuum envelope 511), and has a spring characteristic. The end portion 63*a* is connected (fixed) by the connection structural member 51*a* and a welding portion 65. The cathode holder 13*a* of the cathode electron gun 513 has a predetermined length penetrating through the vacuum envelope holder 59 of the housing 503. The cathode holder 13*a* is electrically connected with a connector (high-voltage supply terminal) 67 on the side opposite to the side where the ground pole 9 of the housing 503 is provided. The connector (high-voltage supply terminal) 67 is used for supplying power to the cathode electron gun.

The end portion 63*a* of the stationary member 63 and the connection structural member 51*a* are fixed by the welding portion 65. In this way, when the vacuum envelope 511 is rotated, this serves to prevent vibration from being transmitted to the cathode electron gun 513. Specifically, the connection structural member 51*a* has a spring characteristic; therefore, vibration generated by a rotation of the vacuum envelope 511 is absorbed. A slight assembly error is absorbed between the cathode holder 13*a* and the cylindrical stationary portion 51.

A plurality of permanent magnets 69 is provided at a predetermined position of the vacuum envelope 511 the side where the cathode electron gun 513 is fixed. The permanent magnets 69 are provided near a bearing 11*a* of the vacuum envelope 511 positioning outside the bearing member 55. The permanent magnets 69 receive thrust (magnetic force) for rotating the vacuum envelope 511.

A stator 71 is provided at a predetermined position of the housing 503. The stator is formed as an electromagnet so that it is controllable from the outside. Therefore, the stator 71 is a coil member. The stator 71 is located coaxially (concentrically) with the permanent magnets 69. The stator 71 provides a magnetic force (thrust) with respect to the permanent magnets 69 at arbitrary timing.

In the X-ray tube assembly 501, a predetermined current is supplied to the stator 71. In this way, the vacuum envelope 511 is rotated at a predetermined speed. Thus, the anode target (rotary anode) 515 provided in the vacuum envelope 511 is rotated at a predetermined speed. In this state, electrons emitted from the cathode electron gun 513 collide with the anode target 515. In this way, X-rays having a predetermined wavelength are output from the anode target 515. The output X-rays are radiated outside from windows 511*b* and 503*a*. The window 511*b* is located at a predetermined position of a cylindrical portion of the vacuum envelope 511. The window 503*a* is located at a predetermined position of a cylindrical portion of the housing 503.

The coolant 7 is injected between most of areas on the outside of the vacuum envelope 511 and internal predetermined areas of the housing 503 via a cooling liquid inlet 5*b*. The cooling liquid inlet 5*b* is located in the vicinity of the bearing portion 11*a* of the vacuum envelope 511. The coolant 7 is discharged from a cooling liquid outlet 5*c* formed near the ground pole 9 outside the housing 503. In this way, the magnetic fluid vacuum sealing member 53 and the anode target 515 built into the vacuum envelope 511 are cooled.

The coolant 7 supplied into the housing 503 is cooled by a heat exchanger 7*b* provided in a cooler unit 7*a*. The coolant 7 is circulated between the cooling liquid inlet 5*b* and the cooling liquid outlet 5*c* by a pump 7*c*. In this way, heat generated in the X-ray tube assembly 501 is released outside the housing 503 using the coolant 7 as a cooling medium.

In this case, the coolant 7 flows near the backside of the magnetic fluid vacuum sealing member 53 via the vacuum envelope 511. Thus, the bearing portion 11*a* (in particular, magnetic fluid vacuum sealing member 53) is effectively cooled. The flow path of the coolant 7 is formed by designing a shape of the housing 503 and the X-ray tube body 505. The flow path of the coolant 7 is suitably designed, and thereby, the coolant 7 can cool the stator 71 together. Most of the heat generated by the X-ray tube assembly 501 is released outside the X-ray tube assembly 501 via the coolant 7.

The end portion 11*c* of the vacuum envelope 511 is positioned at one end portion of thereof, and close to the stationary portion 51 of the housing 503. The end portion 11*c* serves to provide a slight clearance between a projected portion 52 of the stationary portion 51 and the end portion, that is, clearance 5*d* having low wettability. Thus, the clearance 5*d* prevent the coolant 7 from coming into the vacuum envelope 511. In this way, the coolant 7 reaches the magnetic fluid vacuum sealing member 53; therefore, the performance (ability) of the vacuum sealing member 53 is prevented from undesirably reducing.

According to this embodiment, water mixed with glycol is used as the cooling medium. In this case, in order to make the contact angle large, the end portion 11*c* (including the end portion of the permanent magnet 69) of the vacuum envelope 511 and the stationary portion 51 are preferably coated with a resin.

Of the bearing member 55, a bearing member separating from the magnetic fluid vacuum sealing member 53 is a seal type sealed between inner and outer cylinders by a sealing member. This serves to further prevent coolant 7 from coming into the magnetic fluid vacuum sealing member 53.

As described above, one embodiment of the invention is applied to the X-ray tube assembly. In this way, the heat dissipation characteristics is improved by means of the water-based cooling medium. Thus, stable characteristics are secured for the long term. This serves to extend the lifetime of an X-ray image diagnosis apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Figure 6:
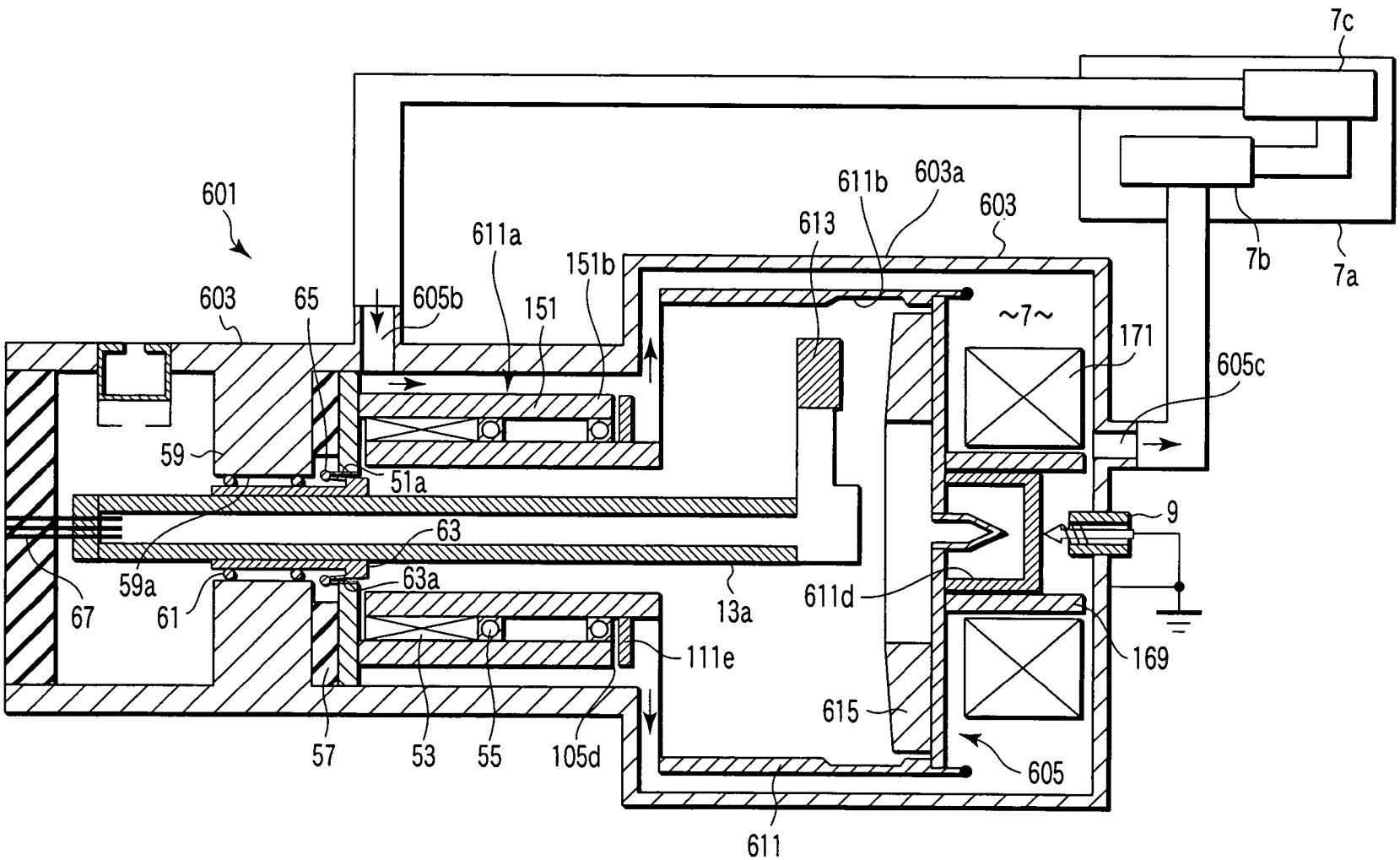
FIG. 6 is a view schematically showing a rotating anode X-ray tube assembly according to one embodiment of the invention.

FIG. 6 relates to another embodiment of the X-ray tube assembly of the present invention. The same reference numbers are used to designate the same members as already described in FIG. 1, and the details are omitted. A reference number adding 600 is given to members similar to members as already described in FIG. 1, and the details are omitted.

An X-ray tube assembly 601 shown in FIG. 6 has a housing 603, and an X-ray tube body (rotating anode X-ray tube) 605 received in the housing 603.

The X-ray tube body 605 is received at a predetermined position in the housing 603 via a coolant 7. The coolant 7 consists of mainly water, and water-based cooling medium (non-oil cooling medium) having a conductivity of less than 1 mS/m.

A vacuum envelope 611 contacts with a ground pole 9 penetrating through a predetermined position of one end of the housing 603 to be grounded.

The inside of the vacuum envelope 611 is kept at a predetermined degree of vacuum. The vacuum envelope 611 is provided with a cathode electron gun (thermally activated electron emission source) 613, and a rotating anode (anode target, anode) 615. The cathode electron gun 613 is provided independently from the vacuum 611. The anode target 615 is located integrally with the vacuum envelope 611 inside the vacuum envelope 611. Electrons emitted from the electron gun 613 collide with the anode target 615, and thereby, the anode target 615 radiates X-rays having a predetermined wavelength.

The vacuum envelope 611 is held by a magnetic fluid vacuum sealing member 53 and a bearing (rolling bearing, ball/roll bearing) member 55. The magnetic fluid vacuum sealing member 53 is located at a predetermined position at the inner peripheral surface of a cylindrical stationary portion 151 provided at a predetermined position of the X-ray tube assembly 605. The bearing member 55 is located at a predetermined position of the stationary portion 151, that is, on the side close to a flow path of the coolant 7 from the magnetic fluid vacuum sealing member 53. The stationary portion 151 is fixed to a vacuum envelope holder 59 of the housing 603 via a support member 57. The stationary portion 151 are concentrically (coaxially) located with the vacuum envelope holder 59.

The cathode electron gun 613 is fixed to a cylindrical and electrical insulating cathode holder 13*a*. A fixing member 63 fixed to the outer peripheral surface of the cathode holder 13*a* and a predetermined area inside a cylinder 59*a* of the vacuum envelope holder 59 are fixed via a sealing member 61. As described above, the cathode electron gun 613 is fixed at a predetermined position inside the vacuum envelope 611.

The fixing member 63 has an end portion 63*a* at the side separating from the fixed to the sealing member 61. A connection structural member 51*a* is connected with the cylindrical stationary portion 151, and has a spring characteristic. The stationary portion 151 supports the vacuum envelope 611 from the outer side of the vacuum envelope 611. The end portion 63*a* is connected (fixed) by the connection structural member 51*a* and a welding portion 65. The cathode holder 13*a* of the cathode electron gun 613 has a predetermined length penetrating through the vacuum envelope holder 59 of the housing 603. The cathode holder 13*a* is electrically connected with a connector (high-voltage supply terminal) 67 on the side opposite to the side where the ground pole 9 of the housing 603 is provided. The connector (high-voltage supply terminal) 67 is used for supplying power to the cathode electron gun.

The end portion 63*a* of the stationary member 63 and the connection structural member 51*a* are fixed by the welding portion 65. In this way, when the vacuum envelope 611 is rotated, this serves to prevent vibration from being transmitted to the cathode electron gun 613. Specifically, the connection structural member 51*a* has a spring characteristic; therefore, vibration generated by a rotation of the vacuum envelope 611 is absorbed.

A plurality of permanent magnets 169 is provided at a predetermined position of the vacuum envelope 611 holding the anode (anode target) 615. The permanent magnets 169 are located near the ground pole 9 and at the following portion (hereinafter, referred to as distal end) 611*d*. The portion 611*d* is smaller than the outer diameter of the vacuum envelope 611 surrounding the anode target 615. The permanent magnets 169 receive thrust (magnetic force) for rotating the vacuum envelope 611.

A predetermined position of the housing 603 is provided with a stator coil 171. The stator coil 171 is located coaxially (concentrically) with the permanent magnets 169. The stator coil 171 provides a magnetic force (thrust) to the permanent magnets 169 at an arbitrary timing. In the X-ray tube apparatus 601, a predetermined current is supplied to the stator 171. In this way, the vacuum envelope 611 is rotated at a predetermined speed. Thus, the anode target (rotating anode) 615 provided in the vacuum envelope 611 is rotated at a predetermined speed. In this state, electrons emitted from the cathode electron gun 613 collide with the anode target 615. In this way, X-rays having a predetermined wavelength are output from the anode target 615. The output X-rays are radiated outside from windows 611*b* and 603*a*. The window 611*b* is located at a predetermined position of a cylindrical portion of the vacuum envelope 611. The window 603*a* is located at a predetermined position of a cylindrical portion of the housing 603.

The coolant 7 is injected between most of areas on the outside of the vacuum envelope 611 and internal predetermined areas of the housing 603 via a cooling liquid inlet 605*b*. The cooling liquid inlet 605*b* is located in the vicinity of the bearing portion 611*a* of the vacuum envelope 611. The coolant 7 is discharged from a cooling liquid outlet 605*c* formed near the ground pole 9 outside the housing 603. In this way, the magnetic fluid vacuum sealing member 53 and the anode target 615 built into the vacuum envelope 611 are cooled.

The coolant 7 supplied into the housing 603 is cooled by a heat exchanger 7*b* provided in a cooler unit 7*a*. The coolant 7 is circulated between the cooling liquid inlet 605*b* and the cooling liquid outlet 605*c* by a pump 7*c*. In this way, heat generated in the X-ray tube apparatus 601 is released outside the housing 603 using the coolant 7 as a cooling medium.

In this case, the coolant 7 effectively cools the magnetic fluid vacuum sealing member 53 and the bearing member 55 via the stationary portion 151. The coolant 7 flows near the backside of the anode target 615 fixed to the vacuum envelope 611. Thus, the bearing portion 611*a* and the anode target 615 are effectively cooled. The flow path of the coolant 7 is designed to contact with the stationary portion 151 formed of metal, in general.

A predetermined position of the vacuum envelope 611 is provided with a flange ille for reducing wettability. The flange 111*e* for reducing wettability is located in the vicinity of the anode target 615 of the vacuum envelope 611 closing to one end portion 151*b* of the stationary portion 151 of the X-ray tube body 605. The flange 111*e* for reducing wettability serves to prevent the coolant 7 from coming into the bearing member 55 and the magnetic fluid vacuum sealing member 53. A small clearance, that is, low wettability clearance 105*d* is formed between the flange 111*e* for reducing wettability and one end portion 151*b* of the stationary portion 151. Thus, the flange 111*e* for reducing wettability and one end portion 151*b* prevent the coolant 7 from coming into the inside of the vacuum envelope 611. In this way, it is possible to prevent the coolant from coming into the magnetic fluid vacuum sealing member 53. This serves to prevent the performance (ability) of the vacuum sealing member 53 from being undesirably reduced.

According to this embodiment, water mixed with glycol is used as the cooling medium. In this case, in order to make the contact angle large, the flange 111*e* and one end portion 151*b* are preferably coated with a resin.

Of the bearing member 55, a bearing member separating from the magnetic fluid vacuum sealing member 53 is a seal type. This serves to further prevent coolant 7 from coming into the magnetic fluid vacuum sealing member 53.

As described above, one embodiment of the invention is applied to the X-ray tube assembly. In this way, the heat dissipation characteristics is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Figure 7:
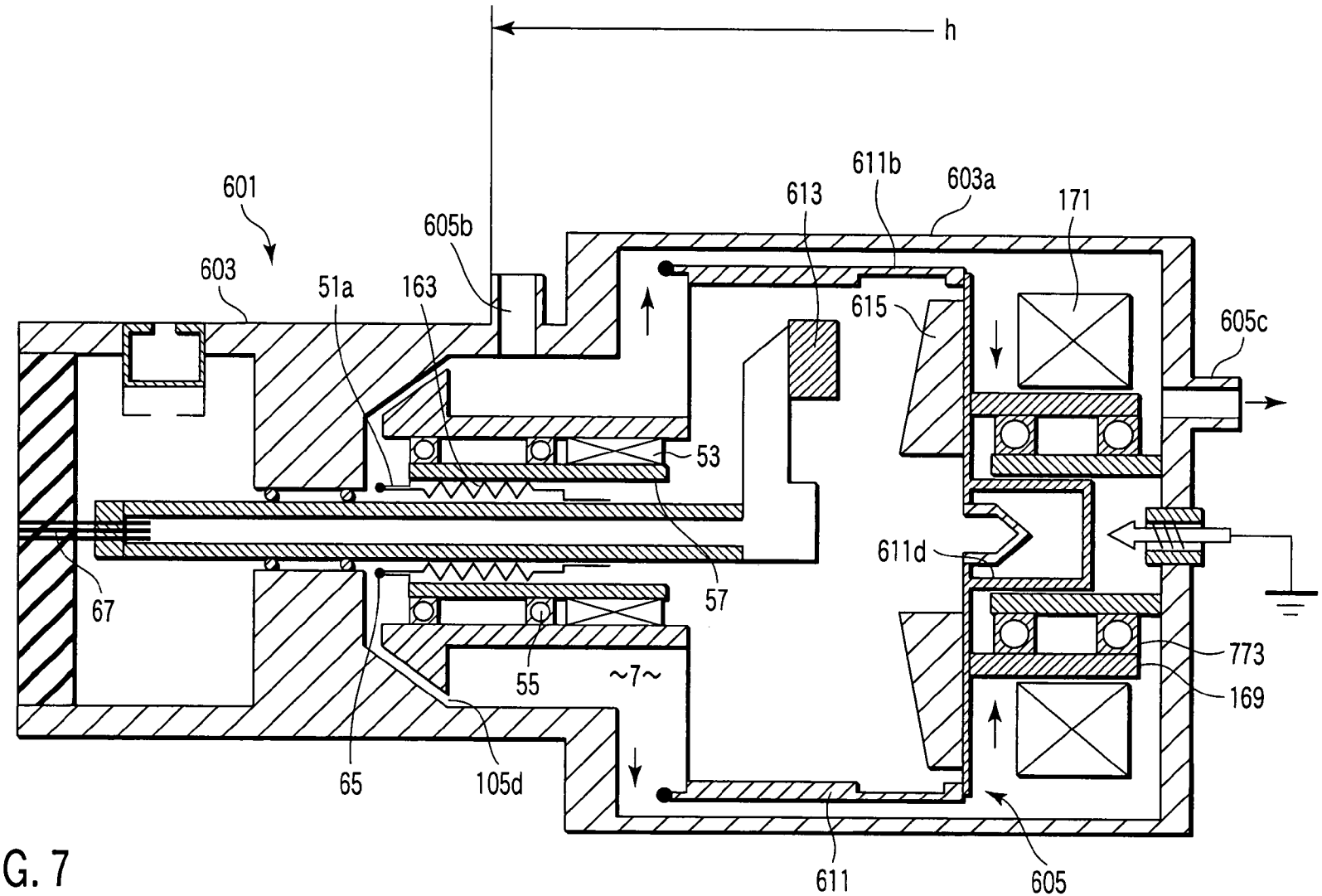
FIG. 7 is a schematic view to explain a method of filling a cooling medium of a rotating anode X-ray tube assembly according to one embodiment of the invention.

As illustrated in FIG. 7, in the X-ray tube assembly shown in FIG. 6, a second bearing member (rolling bearing) 773 is provided between the distal end 611*d* of the vacuum envelope 611 and a rotor (permanent magnet) 169. In other words, as seen from FIG. 7, the second bearing member 773 supports the vacuum envelope 611 on the side of the distal end 611*d*. The center of gravity of the vacuum envelope 611 and the bearing member 773 are close to each other. Thus, when the vacuum envelope 611 is rotated, axial run-out (eccentric rotation) is prevented. Therefore, this serves to reduce vibration generated in the X-ray tube assembly 601.

Using the X-ray tube assembly (601) shown in FIG. 7, the method of injecting (filling) the coolant 7 between the X-ray tube body (105, 605) and the vacuum envelope (111, 611) of the X-ray tube assembly shown in FIGS. 2 (4) and 6 will be described.

As depicted in FIG. 7, the distal end portion 611*d* (111*d*) of the vacuum envelope 611 (111) is directed below, that is, the direction receiving the gravity. In this way, the tube axis of the X-ray tube assembly 601 (101) is located in parallel to the perpendicular direction.

Thus, the cooling liquid inlet 605*b* is positioned above the cathode electron gun 613 (13) and the anode target 615 (15) in the vacuum envelope 611 (111). The cooling liquid inlet 605*b* is positioned in the vicinity of air layer remaining when the coolant 7 is filled (coming into) below.

The coolant saturated with inert gas, that is, helium gas (He) is injected to a position shown by "h" (to the upper portion of the inlet 605*b*) from the inlet 605*b* to the housing 603.

Helium (He) is injected into the remaining space (air layer) (air of the air layer may be replaced).

Thus, the coolant 7 previously contains inert gas in a saturated solution. The coolant 7 contacts with the inert gas between the housing 603 and the vacuum envelope 611.

The flange 111*e* for reducing wettability prevents the coolant 7 from coming into the magnetic fluid vacuum sealing member 53 and the bearing member 55.

If the bearing member 55 is a seal type, the coolant 7 is fully prevented from reaching the magnetic fluid vacuum sealing member 53.

Figure 8:
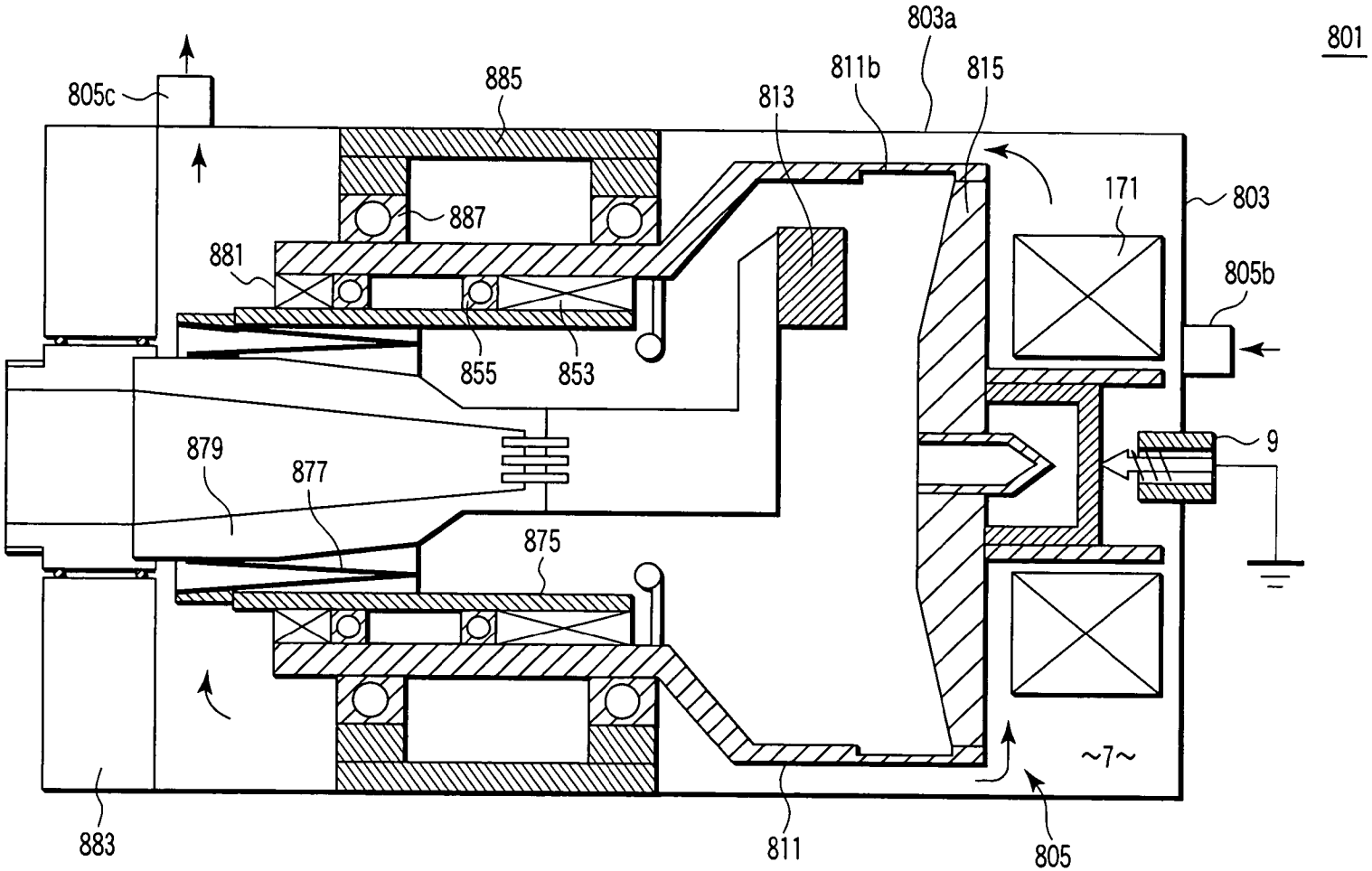
FIG. 8 is a view schematically showing a rotating anode X-ray tube assembly according to one embodiment of the invention.

FIG. 8 relates to another embodiment of the X-ray tube assembly of the present invention. The same reference numbers are used to designate the same members as already described in FIGS. 1 to 7, and the details are omitted. A reference number adding 800 is given to members similar to members as already described in FIGS. 1 to 7, and the details are omitted.

An X-ray tube assembly 801 shown in FIG. 8 has a housing 803, and an X-ray tube body (rotating anode X-ray tube) 805 received in the housing 803.

The X-ray tube body 805 is received at a predetermined position in the housing 803 via a coolant 7. The coolant 7 consists of mainly water, and water-based cooling medium (non-oil cooling medium) having a conductivity of less than 1 mS/m.

A vacuum envelope 811 contacts with a ground pole 9 penetrating through a predetermined position of one end of the housing 803 to be grounded.

The inside of the vacuum envelope 811 is kept at a predetermined degree of vacuum. The vacuum envelope 811 is provided with a cathode electron gun (thermally activated electron emission source) 813, and a rotary anode (anode target, anode) 815. The cathode electron gun 813 is provided independently from the vacuum envelope 811. The anode target 815 is located integrally with the vacuum envelope 811 inside the vacuum envelope 811. Electrons emitted from the electron gun 813 collide with the anode target 815, and thereby, the anode target 815 radiates X-rays having a predetermined wavelength.

The vacuum envelope 811 is held by a magnetic fluid vacuum sealing member 853 and a bearing (rolling bearing, ball/roll bearing) member 855. The magnetic fluid vacuum sealing member 853 is located at a predetermined position on the outer peripheral surface of a cylindrical stationary portion 875 (inserted into the vacuum envelope 811 from the outside) provided at a predetermined position of the housing 803. The bearing member 855 is located at a predetermined position of the stationary portion 875, that is, on the side close to a flow path of the coolant 7 from the magnetic fluid vacuum sealing member 853.

The cylindrical stationary portion 875 is connected with a high-voltage supply receptacle 879 connected to the outside of the housing 803 via a support member 877 formed of two cylindrical thin plates. A sealing member 881 is provided at the side where the bearing member 855 faces one end (release end) of the vacuum envelope 811. In this way, the coolant 7 is prevented from reaching (leaking into) the vacuum envelope passing through the bearing member 855 and the magnetic fluid vacuum sealing member 853.

The high-voltage supply receptacle 879 is fixed at the center of cover member 883 sealing the housing 803.

The electron gun 813 is supported by the receptacle 879 held to the cover member 883. The vacuum envelope 811 is rotatable around the outer periphery of the receptacle 879 in the housing 803.

The bearing member 855 is used for coaxially positioning the stationary portion 875 with respect the vacuum envelope 811. An electrical insulating spacer 885 and a bearing member 887 holds the vacuum envelope 811 so that the vacuum envelope is rotatable in a (cylindrical) space, that is, in the housing 803. A second bearing 887 is a non-seal type.

As described above, one embodiment of the invention is applied to the X-ray tube assembly. In this way, the heat dissipation characteristics is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Figure 9:
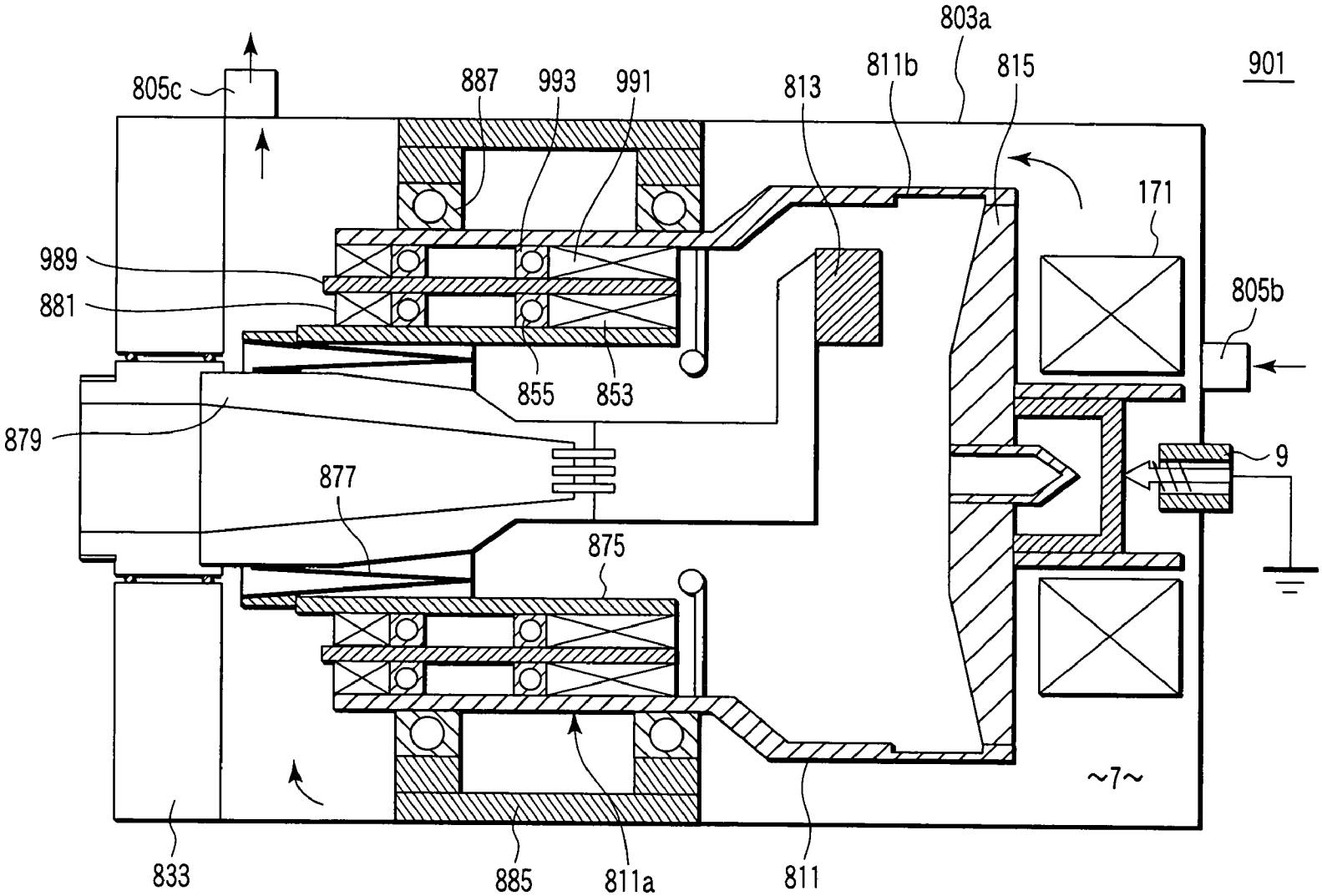
FIG. 9 is a view schematically showing a rotating anode X-ray tube assembly according to one embodiment of the invention.

An X-ray tube assembly 901 according to a modification example of the X-ray tube assembly 801 shown in FIG. 8 will be hereinafter described. As shown in FIG. 9, a second cylindrical stationary portion 989, a second magnetic fluid sealing member 991 and a bearing (rolling bearing) member 993 are interposed between the following members. One is the cylindrical stationary portion 875 of the vacuum envelope 811, and another is the bearing portion 811*a* of the vacuum envelope 811. The stationary portion 875 positioning outside the support member 877 and the vacuum envelope 811 may be supported by means of two stages. In this case, each rotational rate (rotational speed) of the bearing member and the magnetic fluid sealing member becomes about half. Thus, temperature rise (heat) of the bearing member is reduced. Therefore, this serves to prevent the bearing member from being burnt. Vacuum sealing performance of the magnetic fluid sealing member is improved.

Figure 10:
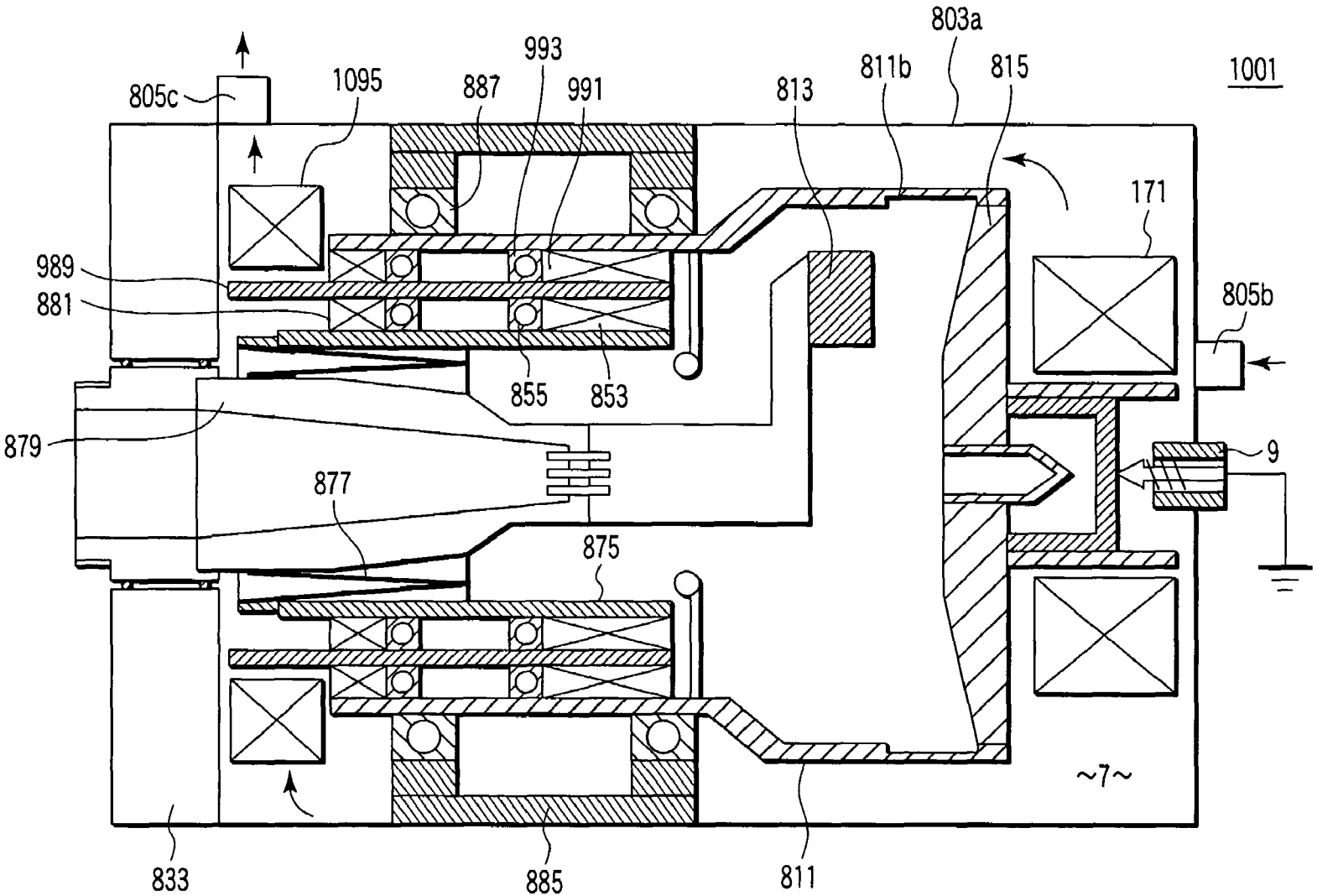
FIG. 10 is a view schematically showing a rotating anode X-ray tube assembly according to one embodiment of the invention.

An X-ray tube assembly 1001 according to a modification example of the X-ray tube assembly 901 shown in FIG. 9 will be hereinafter described. As illustrated in FIG. 10, a second cylindrical stationary portion 989 is formed longer so that its part is used as a rotor. The outer periphery of the stationary portion 989 is provided with a stator coil 1095. In this way, the rotational speed of the cylindrical stationary portion 989 is accurately controlled to becomes ½ of the rotational speed of the vacuum envelope 811.

Figure 11:
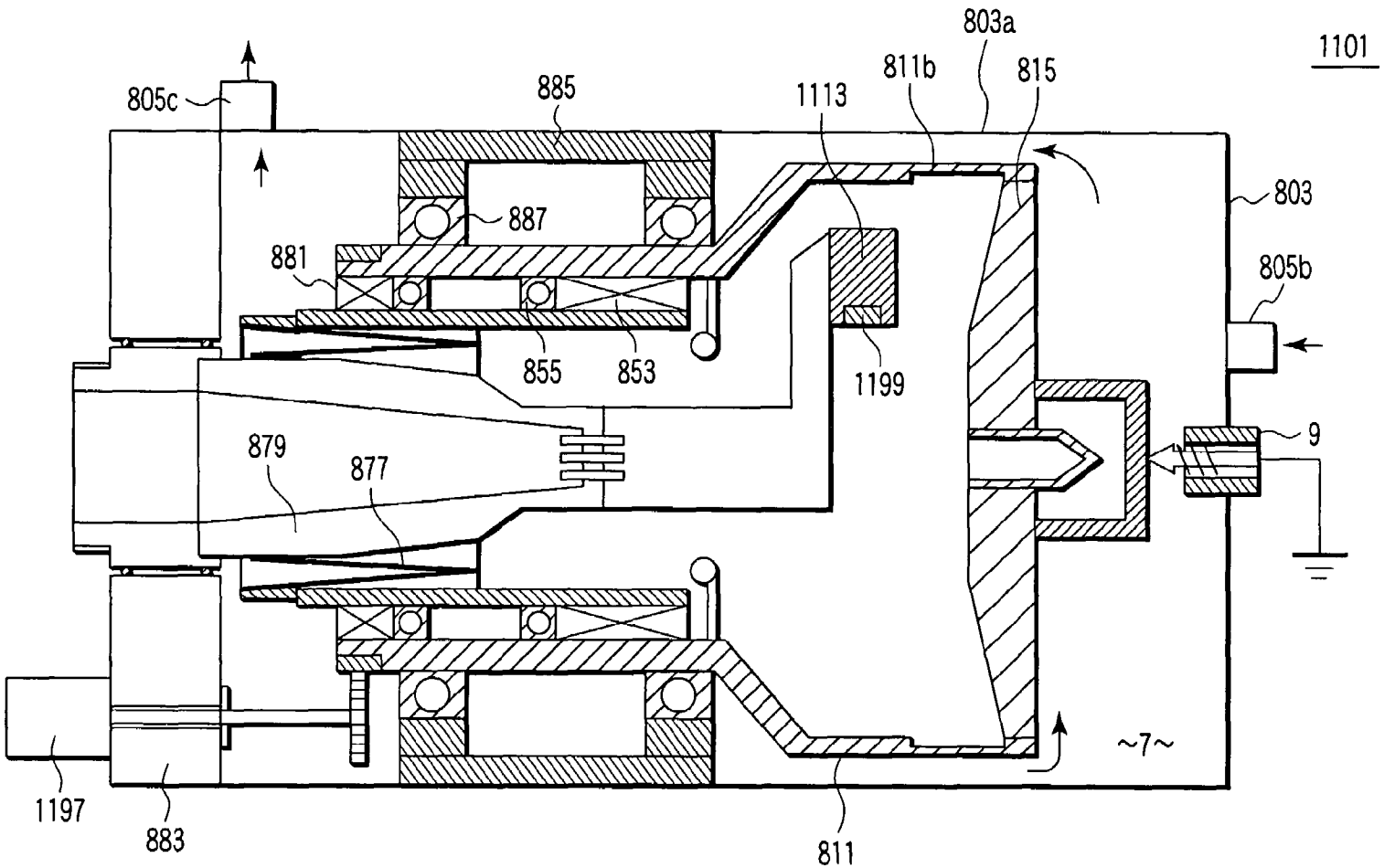
FIG. 11 is a view schematically showing a rotating anode X-ray tube assembly according to one embodiment of the invention.

An X-ray tube assembly 1101 according to a modification example of the X-ray tube apparatus 801 shown in FIG. 8 will be hereinafter described. As depicted in FIG. 11, the X-ray tube assembly 1101 is provided with a rotary mechanism 1197. The rotary mechanism 1197 transmits a driving force (rotating force) to an optional position of the vacuum envelope 811. Using the rotary mechanism 1197, the vacuum envelope 811 is forcibly rotated from the outside.

In the X-ray tube assembly shown in FIGS. 1 to 11, the inner surface of the vacuum envelope may be formed with a getter material, for example a thin film (not shown) such as barium (Ba) and titanium (Ti), by means of vapor deposition. The getter material recovers/absorbs gases generated in the vacuum envelope. As seen from FIG. 11, a current heated getter 1199 may be located in the vacuum envelope 811 via a cathode electron gun 1113.

In the X-ray tube assembly shown in FIGS. 1 to 11, although a cooler unit is not described in detail, the cooler unit is connected with the housing via a removable hose joint, of course.

Figure 12:
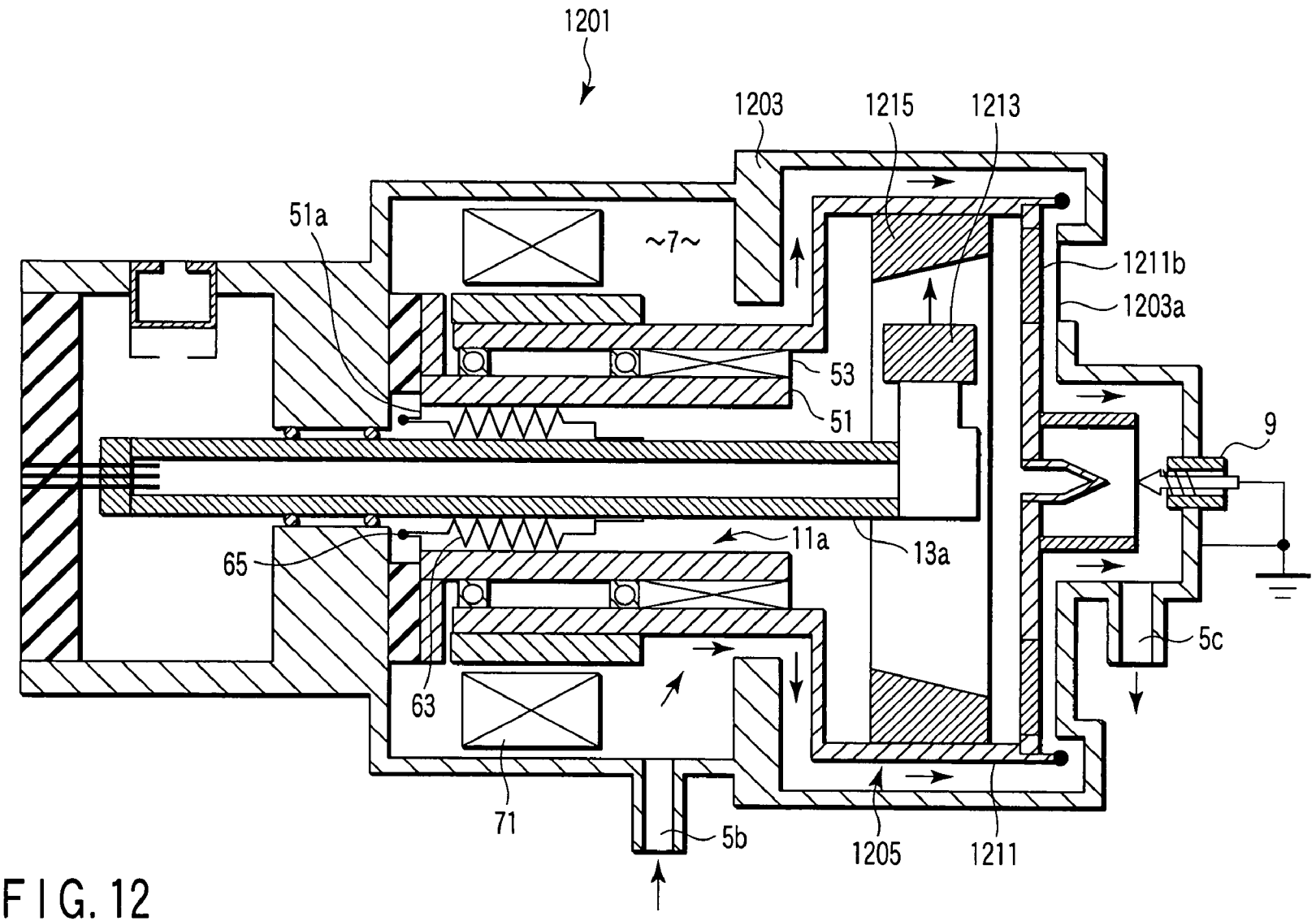
FIG. 12 is a view schematically showing a rotating anode X-ray tube assembly according to one embodiment of the invention.

In the X-ray tube assembly shown in FIGS. 1 to 11, the anode target and the cathode electron gun (thermally activated electron emission source) are located facing each other along the rotating axis of the vacuum envelope. The vacuum envelope and housing each have a window through which X-rays are transmitted. These windows are positioned facing the anode target in the direction perpendicular to the rotating axis. FIG. 12 relates to another embodiment of the X-ray tube assembly of the present invention. The same reference numbers are used to designate the same members as already described in FIG. 3, and the details are omitted. A reference number adding 1200 is given to members similar to members as already described in FIG. 3, and the details are omitted.

As shown in FIG. 12, an X-ray tube assembly 2101 has a housing 1203 and an X-ray tube body 1205 received in the housing 1203. An anode target 1215 is formed into a ring shape, and rotatable together with a vacuum envelope 1211.

The anode target 1215 and the cathode electron gun (thermally activated electron emission source) 1213 are located facing each other in the direction perpendicular to the rotating axis of the vacuum envelope 1211. The vacuum envelope 1211 has a window 1211*b* through which X-rays are transmitted. The housing 1203 has a window 1203*a* through which X-rays are transmitted. The windows 1211*b* and 1203*a* are positioned facing the anode target 1215 in the direction along the rotating axis.

In the X-ray tube assembly 1201, a predetermined current is supplied to the stator 71. In this way, the vacuum envelope 1211 is rotated at a predetermined speed. Thus, the anode target 1215 provided in the vacuum envelope 1211 is rotated at a predetermined speed. In this state, electrons emitted from the cathode electron gun 1213 collide with the anode target 1215. In this way, X-rays having a predetermined wavelength are output from the anode target 1215. The output X-rays are radiated outside from windows 1211*b* and 1203*a*. The window 1211*b* is located at a predetermined position of a cylindrical portion of the vacuum envelope 1211. The window 1203*a* is located at a predetermined position of a cylindrical portion of the housing 1203.

Although no illustration is given, the coolant 7 is cooled by a heat exchanger 7*b* provided in a cooler unit 7*a*, and circulated between a cooling liquid inlet 5*b* and a cooling liquid outlet 5*c* by means of a pump 7*c*.

In the X-ray tube assembly shown in FIG. 12, although the cooler unit is not described in detail, the cooler unit is connected with the housing via a removable hose joint, of course.

Figure 13:
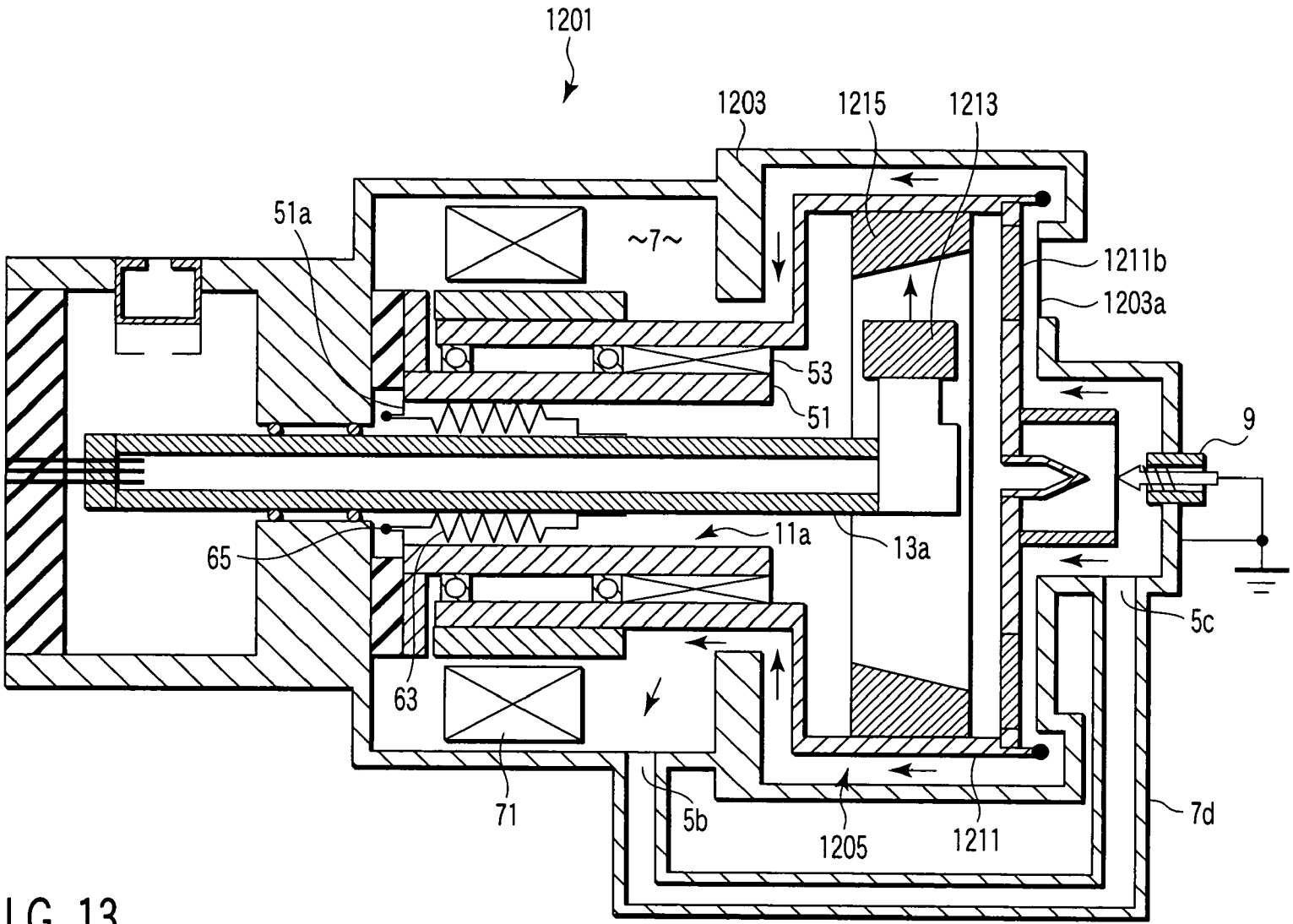
FIG. 13 is a view schematically showing a rotating anode X-ray tube assembly according to one embodiment of the invention.

As illustrated in FIG. 13, the cooling liquid inlet 5*b* and the cooling liquid outlet 5*c* may be connected via a pipe 7*d* without using the cooler unit 7*a*. In this case, the coolant 7 is circulated between the cooling liquid inlet 5*b* and the cooling liquid outlet 5*c* via the pipe 7*d*. Of course, the anode target 1215 and the cathode electron gun 1213 are arranged facing each other in the direction perpendicular to the rotating axis of the vacuum envelope 1211.

Figure 14:
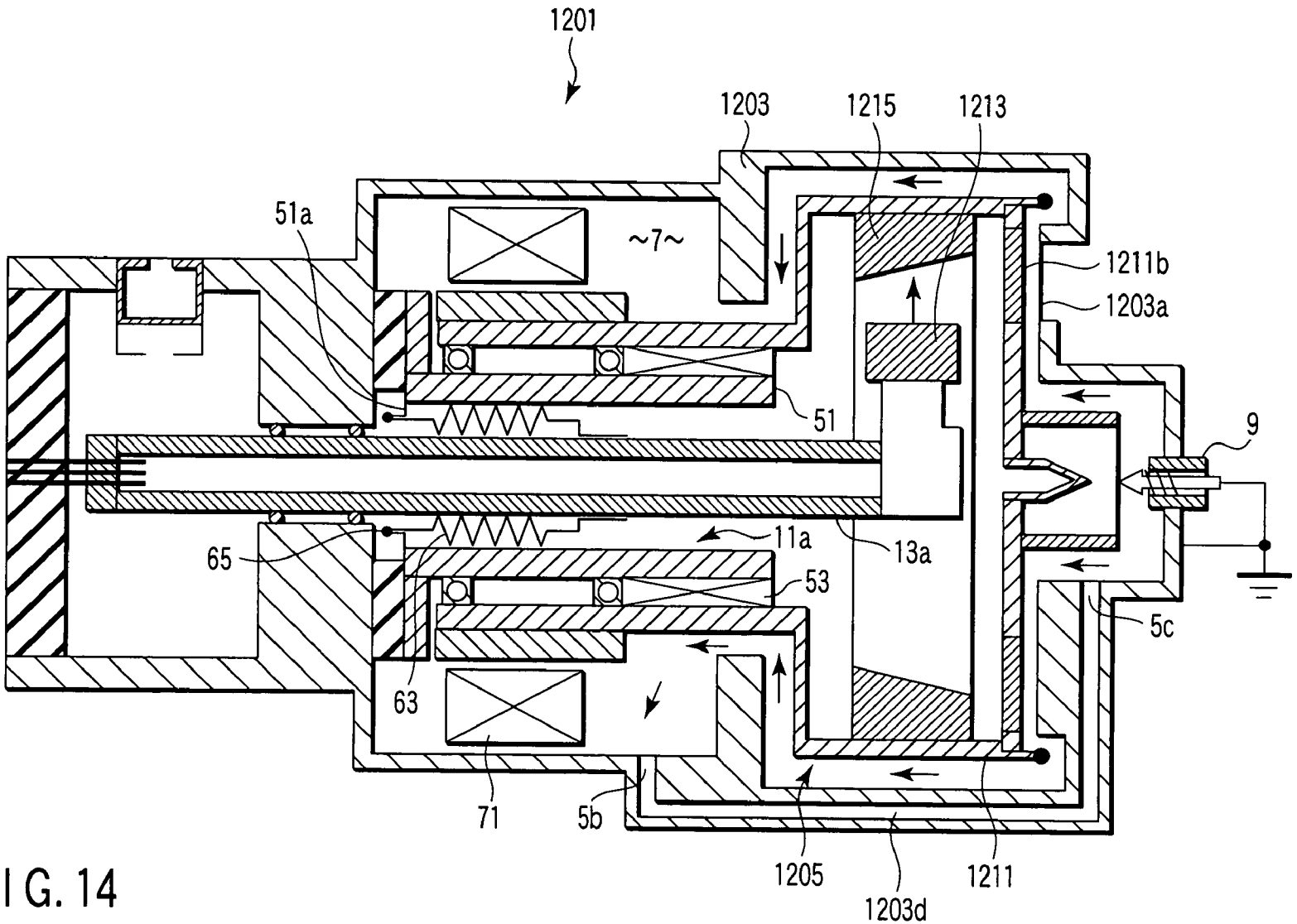
FIG. 14 is a view schematically showing a rotating anode X-ray tube assembly according to one embodiment of the invention.

As seen from FIG. 14, the cooling liquid inlet 5*b* and the cooling liquid outlet 5*c* may be connected via a flow path 1203*d* formed in the housing 1203. In this case, the coolant 7 is circulated between the cooling liquid inlet 5*b* and the cooling liquid outlet 5*c* via the flow path 1203*d*. Of course, the anode target 1215 and the cathode electron gun 1213 are arranged facing each other in the direction perpendicular to the rotating axis of the vacuum envelope 1211.

As described in FIGS. 12 to 14, one embodiment of the invention is applied to the X-ray tube assembly. In this way, the heat dissipation characteristic is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

In the X-ray tube assembly shown in FIGS. 1 to 14, the anode target and the cathode electron gun (thermally activated electron emission source) are arranged facing each other.

Another embodiment of the X-ray tube apparatus of the present invention will be hereinafter described.

Figure 15:
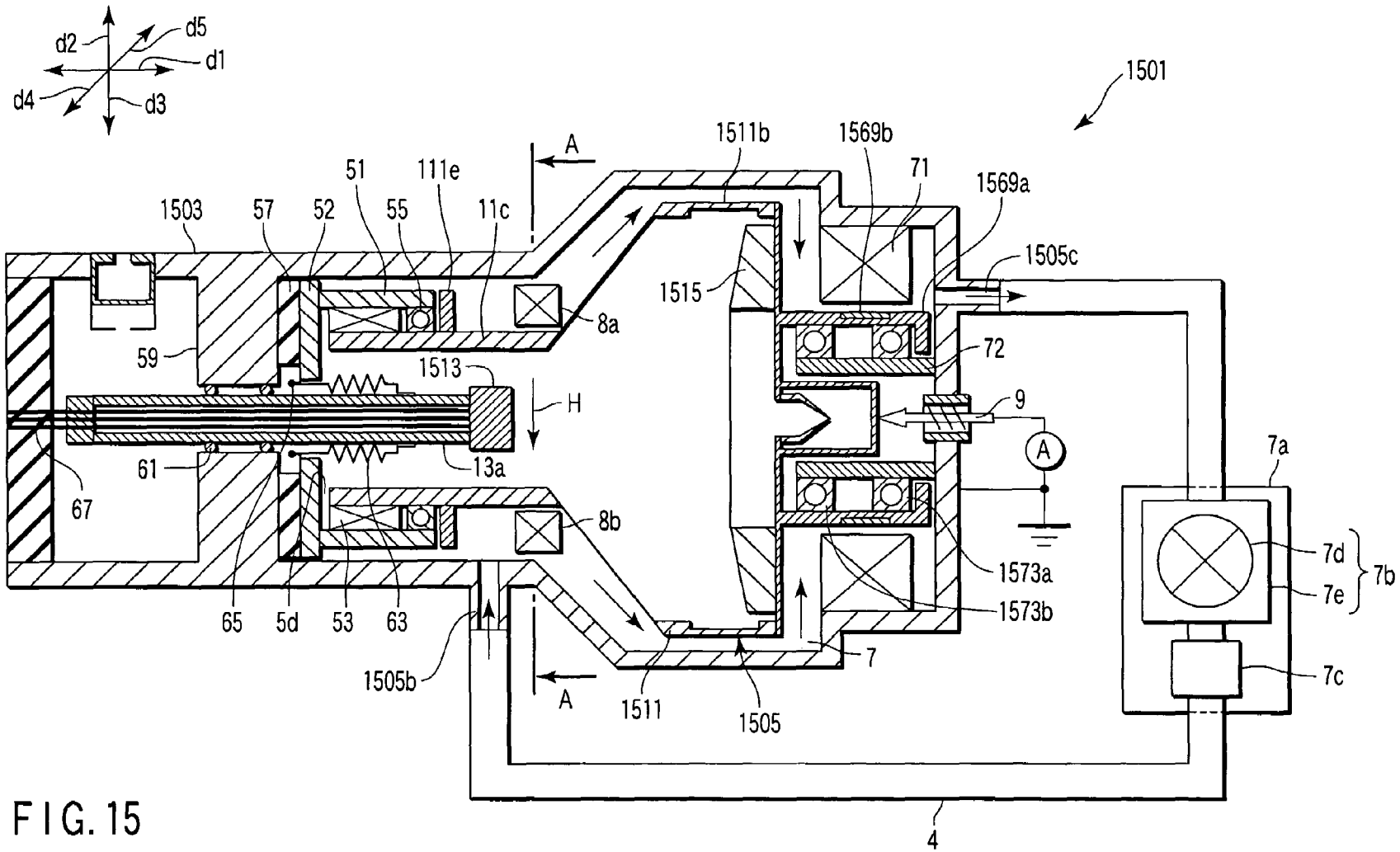
FIG. 15 is a view schematically showing a rotating anode X-ray tube assembly according to one embodiment of the invention.
Figure 16:
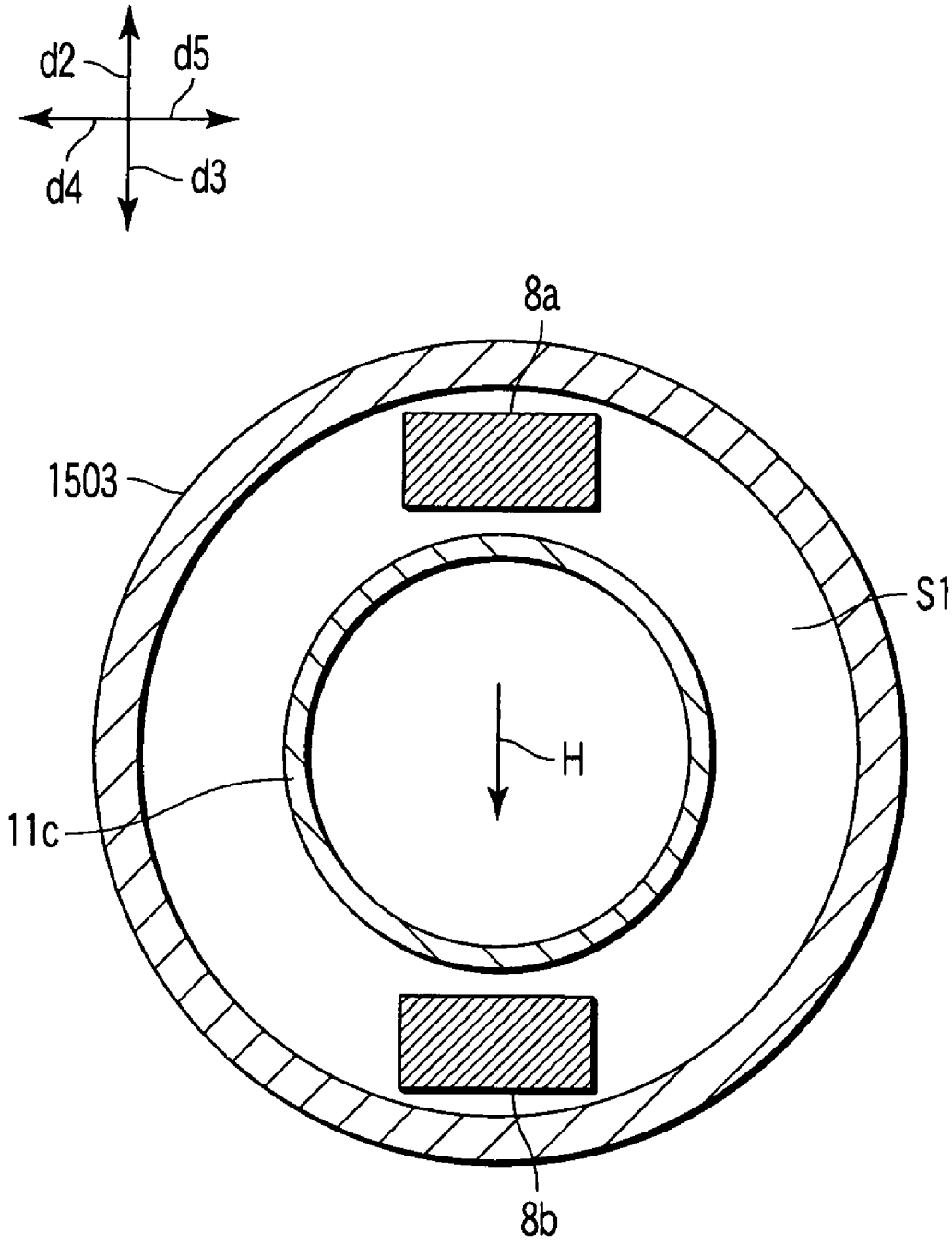
FIG. 16 is an enlarged cross-sectional view showing the rotating anode X-ray tube assembly taken along the line XVI-XVI of FIG. 15, and in particular, a view showing first and second magnetic deflection coils.

As shown in FIGS. 15 and 16, an X-ray tube assembly 1501 is built into an X-ray image diagnostic apparatus and a non-destructive tester, for example. The X-ray tube assembly 1501 radiates X-rays to be irradiated onto an object, that is, a test object. The X-ray tube assembly 1501 has a housing 1503, an X-ray tube body (rotating anode X-ray tube) 1505 and a cooler unit 7*a*.

The X-ray tube body 1505 is received in the housing 1503, and radiates X-rays having a predetermined strength to a predetermined direction. The cooler unit 7*a* releases and circulates the coolant 7 of the X-ray tube body 1505. The X-ray tube body 1505 and the cooler unit 7*a* are connected via a path, that is, a hose 4. The X-ray tube assembly 1501 includes the X-ray tube body (vacuum tube) 1505, the housing 1503 and the coolant 7.

The X-ray tube body 1505 is received in a predetermined position of the housing 1503 via a coolant 7. The coolant 7 consists of mainly water, for example, and is non-oil cooling liquid (water-based cooling medium) having an electric conductivity of less than a predetermined value. A cooling medium having a conductivity of less than 1 mS/m is used as the coolant 7 to secure low-voltage insulation characteristics and to reduce corrosion to metallic components. The cooling medium is water in which glycol, for example, ethylene glycol or propylene glycol, is mixed in a predetermined amount.

The X-ray tube body 1505 includes a vacuum envelope 1511, a cathode electron gun (thermally activated electron emission source) 1513 and a rotary anode (anode target, anode) 1515. The vacuum envelope 1511 is rotatably located so that its entire circumference generally contacts the coolant (water-based cooling medium) 7 contained in the housing 1503. The inside of the vacuum envelope 1511 is kept at a predetermined degree of vacuum.

The cathode electron gun 1513 is provided with and independently of the vacuum envelope 1511. The cathode target 1515 is rotatably located in the vacuum envelope 1511. Electrons emitted from the electron gun 1513 collide with the anode target 1515, and thereby, the anode target 1515 radiates X-rays having a predetermined wavelength.

The cathode 1513 is arranged on the rotating axis of the vacuum envelope 1511. In other words, the cathode 1513 is out of the position facing the anode target 1515.

First and second magnetic deflection coils 8*a* and 8*b* are arranged near the place where the cathode 1513 is located. The first and second magnetic deflection coils 8*a* and 8*b* are provided at a predetermined position of a ring-shaped space S1 between outside the vacuum envelope 1511 and inside the housing. The first and second magnetic deflection coils 8*a* and 8*b* are located facing each other via the vacuum envelope 1511 (end portion 11*c*).

The foregoing first and second magnetic deflection coils 8*a* and 8*b* function as a deflector unit. The first and second magnetic deflection coils 8*a* and 8*b* magnetically deflects an electron beam. The first and second magnetic deflection coils 8*a* and 8*b* forms a magnetic field H for deflecting an electron beam.

The direction along the rotating axis of the vacuum envelope 1511 is set as a first direction d1. The directions perpendicular to the first direction are set as second and third directions d2 and d3. The directions perpendicular to the first to third directions are set as fourth and fifth directions d4 and d5.

According to this embodiment, the first and second magnetic deflection coils 8*a* and 8*b* face the second and third directions d2 and d3. The magnetic field H is formed along the third direction d3 from the first magnetic deflection coil 8*a* toward the second magnetic deflection coil 8*b*.

Thermally induced electrons emitted from the cathode 1513 are accelerated and collected by an electric field between the cathode 1513 and the anode target 1515. The thermally induced electrons come under the influence of the magnetic field H formed by the first and second magnetic deflection coils 8*a* and 8*b*. In this way, the thermally induced electrons collide with the anode target arranged at a position away from the rotating axis in a direction (radius direction) perpendicular to the rotating axis. In this embodiment, although no illustration is given, the thermally induced electrons are deflected in the fourth direction d4 by the magnetic field H to collide with the anode target 1515.

The vacuum envelope 1511 contacts with a ground pole 9 provided penetrating through a predetermined position of one end portion of the housing 1503 to be grounded.

The vacuum envelope 1511 is held by bearing (roll bearing, ball/roll bearing) members 1573*a* and 1573*b*. The bearing members 1573*a* and 1573*b* are located at the predetermined positions between the following portions. One is an inner peripheral surface of a rotor 1569*a* provided at one end portion on the side holding the anode target 1515. Another is an outer peripheral surface of a stationary portion 72 comprising a cylindrical insulator provided at a predetermined position of the housing 1503. The load of the vacuum envelope 1511 is supported by the bearing members 1573*a* and 1573*b*.

The outer peripheral surface of the rotor 1569*a* is provided with a plurality of permanent magnets 1569*b* receiving thrust (magnetic force) for rotating the vacuum envelope 1511.

A stator 71 is provided at a predetermined position of the housing 1503 coaxially (concentrically) with the permanent magnets 1569*b* provided around the rotor 1569*a*. The stator provides a magnetic force (thrust) with respect to the permanent magnets 1569*b* at an arbitrary timing.

In the X-ray tube assembly 1501, a predetermined current is supplied to the stator 71. In this way, the vacuum envelope 1511 is rotated at a predetermined speed. Thus, the anode target 1515 provided in the vacuum envelope 1511 is rotated at a predetermined speed. In this state, electrons emitted from the cathode electron gun 1513 collide with the anode target 1515. In this way, X-rays having a predetermined wavelength are output from the anode target 1515. The output X-rays are radiated outside from windows 1511*b* and 1503*a* (not shown). The window 1511*b* is located at a predetermined position of a cylindrical portion of the vacuum envelope 1511. The window 1503*a* is located at a predetermined position of a cylindrical portion of the housing 1503.

The magnetic fluid vacuum sealing member 53 is provided at the inner peripheral surface of the cylindrical stationary portion 51 located at a predetermined position of the housing 1503 on the side holding the cathode 1513. The bearing member 55 is provided at a predetermined position of the stationary portion 51, and located on the side close to a flow path of the coolant 7 as compared with the magnetic fluid vacuum sealing member 53.

The cylindrical stationary portion 51 is fixed to a projected portion 52 given as a flange. The projected portion 52 is concentrically (coaxially) fixed to the envelope holder 59 of the housing 1503 via a support member 57 comprising an insulator. The bearing member 55 does not support the load of the vacuum envelope 1511, but has a function of coaxial positioning of the vacuum envelope 1511 and the stationary portion 51.

The cathode 1513 is fixed to a cathode holder 13*a* comprising a cylindrical insulator. The outer peripheral surface of the cathode holder 13*a* and a predetermined area inside a cylinder portion of the vacuum envelope holder 59 are fixed via a sealing member 61. Thus, the cathode 1513 is fixed at a predetermined position inside the vacuum envelope 1511.

The cathode holder 13*a* attached with the cathode 1513 has a predetermined length penetrating through the vacuum envelope holder 59 of the housing 3. The cathode holder 13*a* is electrically connected with a connector (high-voltage supply terminal) 67 on the side opposite to the side where the ground pole 9 of the housing 1503 is provided. The connector (high-voltage supply terminal) 67 is used for supplying power to the cathode 1513.

The fixing member 63 has a bellows shape having a spring characteristic. Thus, when the vacuum envelope 1511 is rotated, vibration is prevented from being transmitted to the cathode 1513. The fixing member 63 has a spring characteristic, and thereby, a slight assembly error of the cathode holder 13*a* and the projected portion 52 is absorbed.

The coolant 7 is injected into a space between an outer predetermined area of the vacuum envelope 1511 and an inner predetermined area of the housing 1503 via a cooling liquid inlet 5*b*. The cooling liquid inlet 5*b* is located in the vicinity of the magnetic deflection coil 8. The coolant 7 is discharged from a cooling liquid outlet 1505*c* outside the housing 1503. The cooling liquid outlet 1505*c* is located near the ground pole 9. In this way, the anode target 1515 built into the vacuum envelope 1511 is cooled. A wall surface of the vacuum envelope including a window 1511*b* near the anode target 1515 receives impact of recoil electrons, which are some of the acceleration electrons colliding with the anode target 1515, and thereafter, is heated. However, the wall surface of the vacuum envelope is cooled by the coolant 7. The anode target 1515 and the vacuum envelope 1511 are rotated at a high speed. The foregoing rotating operation contributes for increasing a cooling efficiency.

The cathode 1513 and the anode target 1515 are located inside the vacuum envelope 1511. The inside of the vacuum envelope 1511 is kept at a predetermined vacuum state by the magnetic fluid vacuum sealing member 53.

The coolant supplied into the housing 1503 is cooled by a heat exchanger 7*b* provided in a cooler unit 7*a*. The heat exchanger 7*b* has a fan 7*d* and a radiator 7*e*. The coolant 7 is circulated between the cooling liquid inlet 1505*b* and the cooling liquid outlet 1505*c* by a pump 7*c*. In this way, heat generated in the anode target 1515 and the window 1511*b* receiving the impact of recoil electrons is removed outside the housing 1503 via the coolant 7.

In this case, the coolant 7 cools the magnetic fluid vacuum sealing member 53, the stator 71, and the first and second magnetic deflection coils 8*a* and 8*b* together in addition to the anode target 1515 and the window 1511*b*. Thus, each member is kept less than an allowable temperature. The flow path of the coolant is formed by designing a shape of the housing 1503.

The end portion 11*c* of the vacuum envelope 1511 is positioned at one end portion of the vacuum envelope 1511, and close to the stationary portion 51 of the housing 1503. The end portion 11*c* provides a small clearance between the projected portion 52 of the stationary portion 51 and the end portion, that is, clearance 5*d* having low wettability. Thus, the clearance 5*d* serves to prevent the coolant 7 from coming into the inside of the vacuum envelope 1511. In addition, the clearance 5*d* serves to prevent the coolant 7 from coming into the magnetic fluid vacuum sealing member 53. Therefore, the performance (ability) of the magnetic fluid vacuum sealing member 53 is prevented from being undesirably reduced.

According to this embodiment, water having high wettability or water mixed with glycol is used as a cooling medium. In order to make large a contact angle, the surface of the end portion 11*c* of the vacuum envelope 1511 and the stationary portion 51 facing it are preferably coated with a resin. The bearing member 55 is a seal type such that a space between inner and outer cylinders is sealed by means of a sealing member. This serves to further prevent the coolant 7 from coming into the magnetic fluid vacuum sealing member 53.

As described above, one embodiment of the invention is applied to the X-ray tube assembly. In this way, the heat dissipation characteristic is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Another embodiment of the X-ray tube assembly of the present invention will be hereinafter described. The same reference numbers are used to designate the same components as already described in FIG. 15, and the details are omitted.

Figure 17:
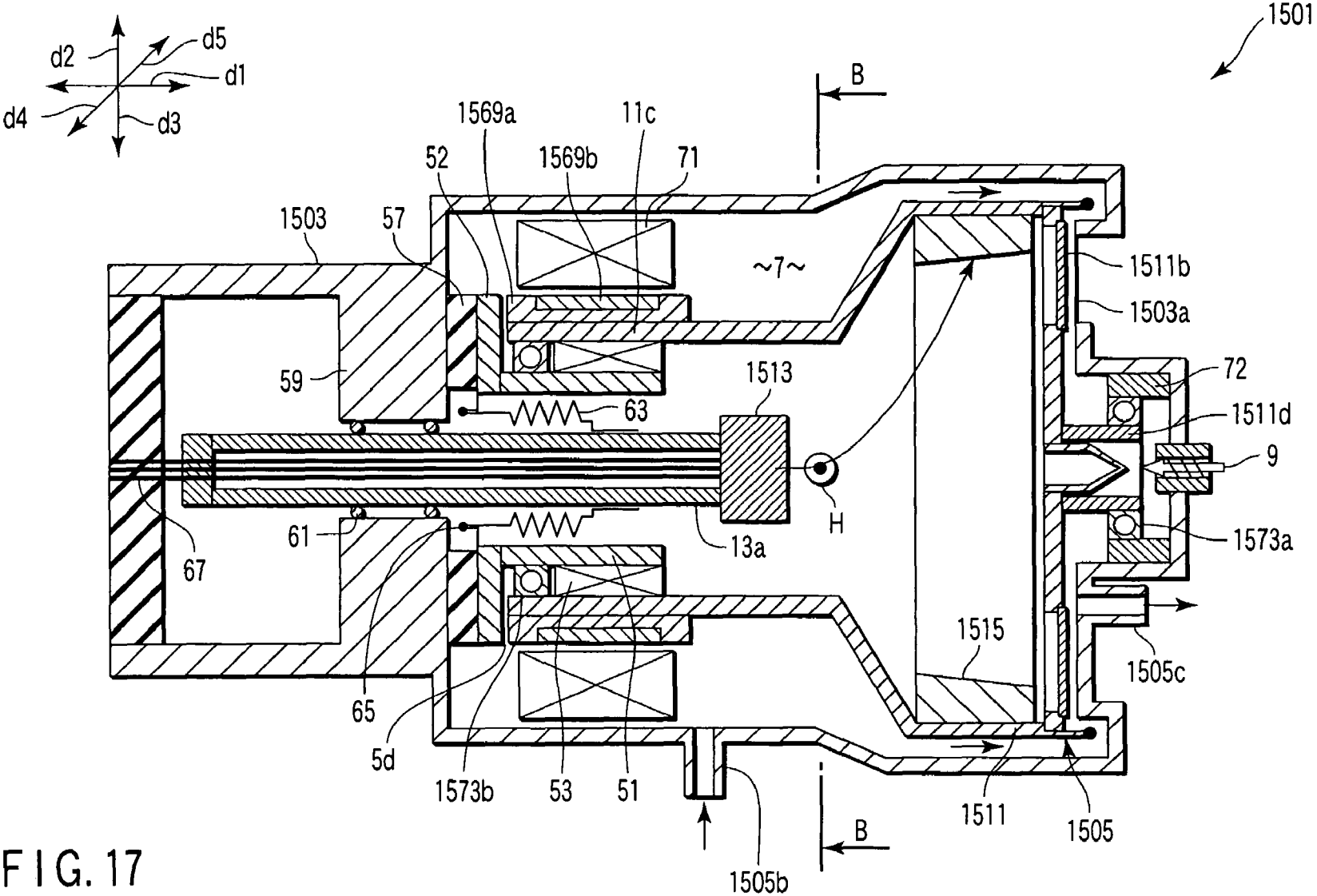
FIG. 17 is a view schematically showing a rotating anode X-ray tube assembly according to one embodiment of the invention.
Figure 18:
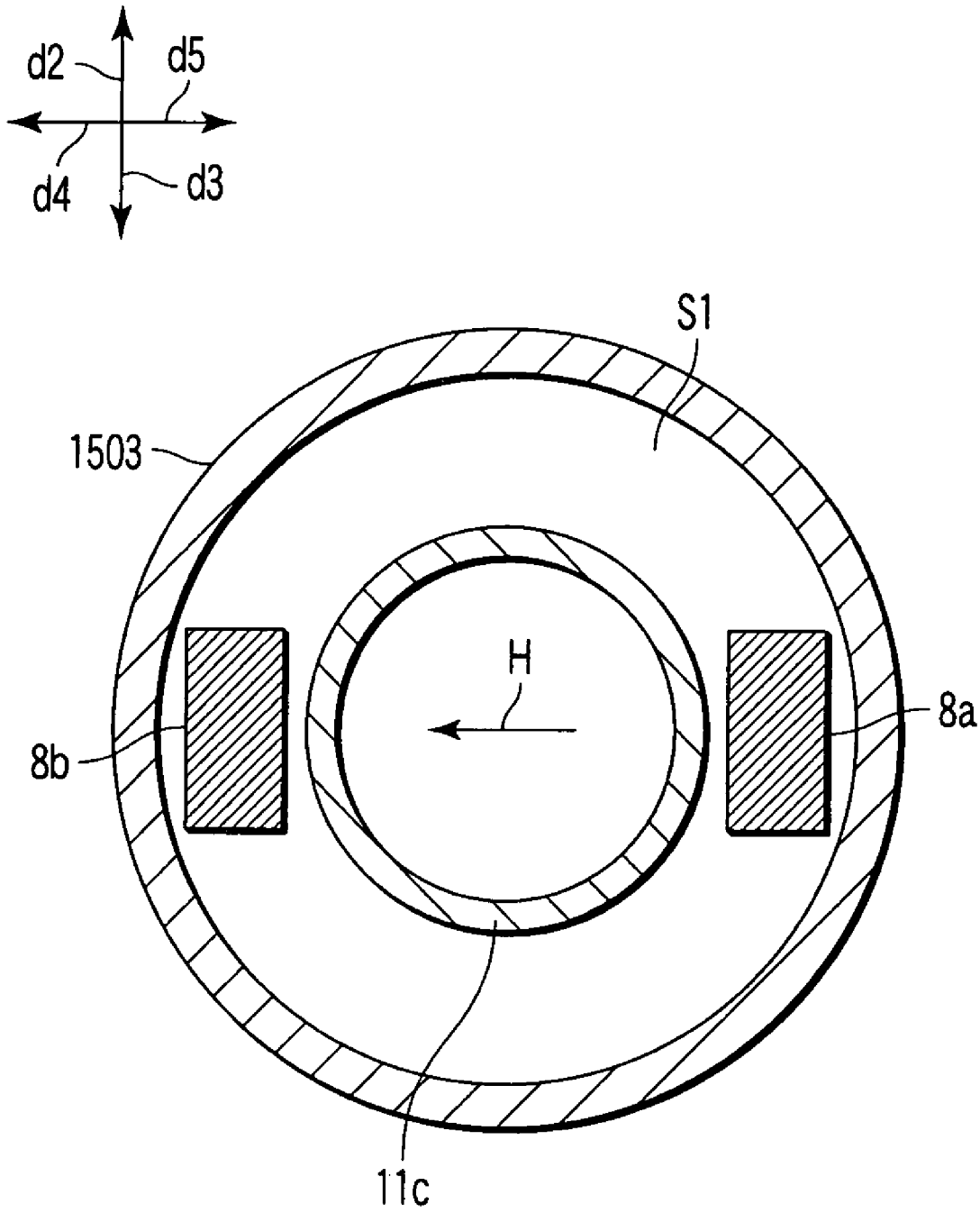
FIG. 18 is an enlarged cross-sectional view showing the rotating anode X-ray tube assembly taken along the line XVIII-XVIII of FIG. 17, and in particular, a view showing first and second magnetic deflection coils.

As shown in FIGS. 17 and 18, an X-ray tube assembly 1501 has a housing 1503, and an X-ray tube body (rotating anode X-ray tube) 1505 received in the housing 1503. Although no illustration is given, the X-ray tube assembly 1501 has a cooler unit 7*a*.

The X-ray tube body 1505 is received at a predetermined position of the housing 1503 via a coolant 7. The coolant 7 consists of mainly water as a man component, and is a non-oil cooling liquid (water-based cooling medium) of electric conductivity less than a predetermined value.

The X-ray tube body 1505 includes a vacuum envelope 1511, a cathode (thermally activated electron emission source) 1513, a rotating anode (anode target, anode) 1515. The entire circumference of the vacuum envelope 1511 generally contacts with the coolant 7 filled in the housing 1503. The vacuum envelope 1511 is rotatably located. The inside of the vacuum envelope is kept at a predetermined degree of vacuum.

The cathode 1513 is located inside the vacuum envelope 1511 independently from the vacuum envelope 1511. The anode target 1515 is formed into a ring shape. The anode target 1515 is inside the vacuum envelope 1511 integrally with the vacuum envelope 1511. The anode target 1515 collides with electrons emitted from the cathode 1513, and thereby, radiates X-rays.

The cathode 1513 is arranged on the rotating axis of the vacuum envelope 1511. In other words, the cathode 1513 is out of the position facing the anode target 1515.

First and second magnetic deflection coils 8*a* and 8*b* are arranged in the vicinity of the place where the cathode 1513 is located. The first and second magnetic deflection coils 8*a* and 8*b* are arranged at a predetermined position of a ring-shape space S1 between outside the vacuum envelope 1511 and inside the housing 1511. The first and second magnetic deflection coils 8*a* and 8*b* are arranged facing each other via the vacuum envelope 1511 (end portion 11*c*).

The foregoing first and second magnetic deflection coils 8*a* and 8*b* function as a deflector unit. The first and second magnetic deflection coils 8*a* and 8*b* magnetically deflects an electron beam. The first and second magnetic deflection coils 8*a* and 8*b* forms a magnetic field H for deflecting an electron beam.

According to this embodiment, the first and second magnetic deflection coils 8*a* and 8*b* faces each other in the fourth and fifth directions d4 and d5. A magnetic field H is formed in the fourth direction d4 from the first magnetic deflection coils 8*a* toward the second magnetic deflection coils 8*b*.

Thermally induced electrons emitted from the cathode 1513 are accelerated and collected by an electric field between the cathode 1513 and the anode target 1515. The thermally induced electrons come under the influence of the magnetic field H formed by the first and second magnetic deflection coils 8*a* and 8*b*. In this way, the thermally induced electrons collide with the anode target arranged at a position away from the rotating axis in a direction (radius direction) perpendicular to the rotating axis. In this embodiment, although no illustration is given, the thermally induced electrons are deflected in the second direction d2 by the magnetic field H to collide with the anode target 1515.

The vacuum envelope 1511 contacts with a ground pole 9 provided penetrating through a predetermined position of one end portion of the housing 1503 to be grounded.

The vacuum envelope 1511 is held by bearing (roll bearing, ball/roll bearing) members 1573*a* and 1573*b*.

The bearing members 1573*a* is located at the predetermined positions between an inner peripheral surface of a cylindrical distal end portion 1511*d* and an inner peripheral surface of a stationary portion 72. The distal end portion 1511*d* is located at one end portion on the side holding the anode target 1515. The stationary portion 72 is located at a predetermined position of the housing 1503, and comprises a cylindrical insulator.

The magnetic fluid vacuum sealing member 53 is located at the outer peripheral surface of a cylindrical stationary portion 51. The stationary portion 51 is located at a predetermined position of the housing on the side holding the cathode 1513.

The bearing member 1573*b* is located at a predetermined position of the stationary portion 51 and on the side close to the flow path of the coolant 7 as compared with the magnetic fluid vacuum sealing member 53.

The load of the vacuum envelope 151 is supported by the bearing members 1573*a* and 1573*b*. The vacuum envelope 1511 has an end portion 11*c* at one end portion on the side attached with the bearing member 1573*b*. The outer peripheral surface of the end portion 11*c* is provided with a rotor 1569*a*. The rotor 1569*a* is made of copper.

The outer peripheral surface of the rotor 1569*a* is provided with a plurality of permanent magnets 1569*b*. The permanent magnets 1569*b* receive thrust (magnetic force) for rotating the vacuum envelope 1511.

A stator 71 is provided at a predetermined position of the housing 1503. The housing 1503 is located coaxially (concentrically) with the permanent magnets 1569*b*. The stator 71 provides a magnetic force (thrust) with respect to the permanent magnets 1569*b* at an arbitrary timing.

In the X-ray tube assembly 1501, a predetermined current is supplied to the stator 71. In this way, the vacuum envelope 1511 is rotated at a predetermined speed. Thus, the anode target 1515 provided in the vacuum envelope 1511 is rotated at a predetermined speed. In this state, electrons emitted from the cathode electron gun 1513 collide with the anode target 1515. In this way, X-rays having a predetermined wavelength are output from the anode target 1515. The output X-rays are radiated outside from windows 1511*b* and 1503*a*. The window 1511*b* is located at a predetermined position of the side portion of the vacuum envelope 1511. The window 1503*a* is located at a predetermined position of the side of the housing 1503. The windows 1511*b* and 1503*a* is located facing the anode target in the direction along the rotating axis of the vacuum envelope 1511.

The cylindrical stationary portion 51 is fixed to a projected portion 52 given as a flange. The projected portion 52 is concentrically (coaxially) fixed to the envelope holder 59 of the housing 1503 via a support member 57 comprising an insulator. The bearing member 1573*b* supports part of the load of the vacuum envelope 1511. The bearing member 1573*b* has a function of coaxially positioning the vacuum envelope 1511 and the stationary portion 51.

The cathode 1513 is fixed to a cathode holder 13*a* comprising a cylindrical insulator. The outer peripheral surface of the cathode holder 13*a* and a predetermined area inside a cylinder portion of the vacuum envelope holder 59 are fixed via a sealing member 61. Thus, the cathode 1513 is fixed at a predetermined position inside the vacuum envelope 1511.

The fixing member 63 has a bellows shape having a spring characteristic. Thus, when the vacuum envelope 1511 is rotated, vibration is prevented from being transmitted to the cathode 1513. The fixing member 63 has a spring characteristic, and thereby, a slight assembly error of the cathode holder 13*a* and the projected portion 52 is absorbed.

The coolant 7 is injected into a space between an outer predetermined area of the vacuum envelope 1511 and an inner predetermined area of the housing 1503 via a cooling liquid inlet 1505*b*. The cooling liquid inlet 1505*b* is located in the vicinity of the magnetic deflection coils 8*a* and 8*b*. The coolant 7 is discharged from a cooling liquid outlet 1505*c* outside the housing 1503. The cooling liquid outlet 1505*c* is located near the ground pole 9. In this way, the anode target 1515 built into the vacuum envelope 1511 is cooled.

A wall surface of the vacuum envelope including a window 1511*b* near the anode target 1515 receives the impact of recoil electrons, which are some of the acceleration electrons colliding with the anode target 1515, and thereafter, is heated. However, the wall surface of the vacuum envelope is cooled by the coolant 7. The anode target 1515 and the vacuum envelope 1511 are rotated at a high speed. The foregoing rotating operation contributes for increasing a cooling efficiency.

The cathode 1513 and the anode target 1515 are located inside the vacuum envelope 1511. The inside of the vacuum envelope 1511 is kept at a predetermined vacuum state by the magnetic fluid vacuum sealing member 53.

The coolant 7 supplied into the housing 1503 is cooled by a heat exchanger 7*b* provided in a cooler unit 7*a*. The coolant 7 is circulated between the cooling liquid inlet 1505*b* and the cooling liquid outlet 1505*c* by a pump 7*c*. In this way, heat generated in the anode target 1515 and the window 1511*b* receiving the impact of recoil electrons is removed outside the housing 1503 via the coolant 7.

In this case, the coolant 7 cools the magnetic fluid vacuum sealing member 53, the stator 71, and the first and second magnetic deflection coils 8*a* and 8*b* together in addition to the anode target 1515 and the window 1511*b*. Thus, each member is kept less than an allowable temperature. The flow path of the coolant 7 is formed by designing a shape of the housing 1503.

The end portion 11*c* and the rotor 1569*a* are close to the projected portion 52. The end portion 11*c* and the rotor 1569*a* provide a small clearance between the stationary portion 51 and the projected portion 52, that is, clearance 5*d* having low wettability. Thus, the clearance 5*d* serves to prevent the coolant 7 from coming into the inside of the vacuum envelope 1511. In addition, the clearance 5*d* serves to prevent the coolant 7 from coming into the magnetic fluid vacuum sealing member 53. Therefore, the performance (ability) of the magnetic fluid vacuum sealing member 53 is prevented from being undesirably reduced.

According to this embodiment, water having high wettability or water mixed with glycol is used as a cooling medium. In order to make large a contact angle, the surface of the end portion 11*c* of the vacuum envelope 1511 and the projected portion 52 facing it are preferably coated with a resin. The bearing member 1573*b* is a seal type such that a space between inner and outer cylinders is sealed by means of a sealing member. This serves to further prevent the coolant 7 from coming into the magnetic fluid vacuum sealing member 53.

As described above, one embodiment of the invention is applied to the X-ray tube assembly. In this way, the heat dissipation characteristics is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

Another embodiment of the X-ray tube assembly of the present invention will be hereinafter described. The same reference numbers are used to designate the same components as already described in FIG. 17, and the details are omitted.

Figure 19:
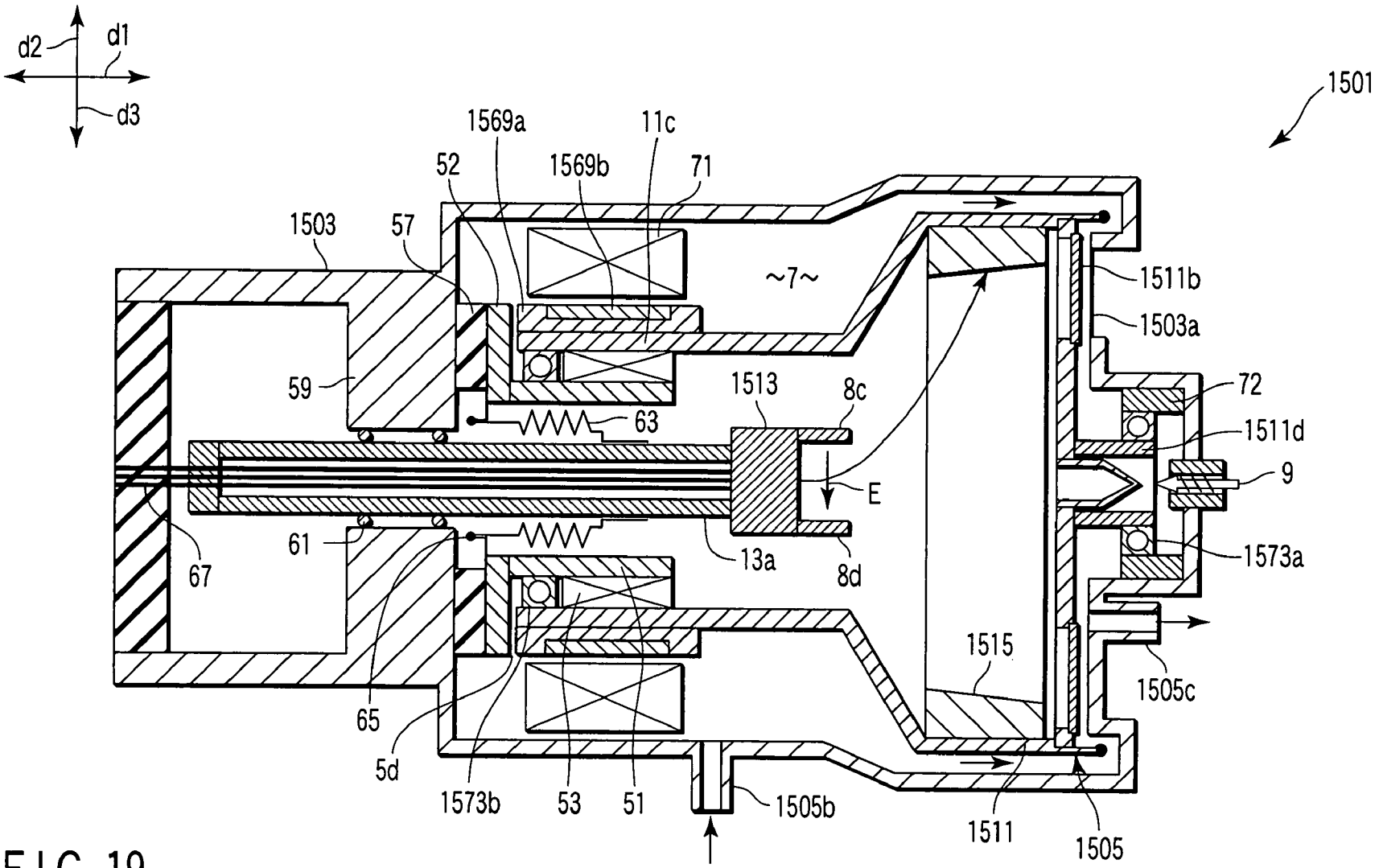
FIG. 19 is a view schematically showing a rotating anode X-ray tube assembly according to one embodiment of the invention.

As shown in FIG. 19, an X-ray tube assembly 1501 has a housing 1503, and an X-ray tube body (rotating anode X-ray tube) 1505 received in the housing 1503. Although no illustration is given, the X-ray tube assembly 1501 has a cooler unit 7*a*.

According to this embodiment, the X-ray tube assembly 1501 has no first and second magnetic deflection coils 8*a* and 8*b*. A first deflection electrode 8*c* given as a positive deflection electrode and a second deflection electrode 8*d* given as a negative deflection electrode are arranged in the vicinity of the place where the cathode 1513 is located. Concerning voltage applied to the first and second deflection electrodes 8*c* and 8*d*, a positive voltage is relatively applied to the first deflection electrode 8*c*. On the other hand, a negative voltage is relatively applied to the second deflection electrode 8*d*.

The first and second deflection electrodes 8*c* and 8*d* are arranged inside the vacuum envelope 1511, and located facing each other with intervals. The first and second deflection electrodes 8*c* and 8*d* are individually fixed to the cathode 1513 via an electrical insulating member.

The first and second deflection electrodes 8*c* and 8*d* function as a deflector unit. The first and second deflection electrodes 8*c* and 8*d* electrically deflect an electron beam. The first and second deflection electrodes 8*c* and 8*d* generate an electric field E for deflecting the electron beam.

According to this embodiment, the first and second deflection electrodes 8*c* and 8*d* face each other in the second direction d2 (third direction d3). The electric field E is formed in the third direction d3 from the first deflection electrodes 8*c* toward the second deflection electrode 8*d*.

Thermally induced electrons emitted from the cathode 1513 are accelerated and collected by an electric field between the cathode 1513 and the anode target 1515. The thermally induced electrons are acted on by the electric field E generated by the first and second deflection electrodes 8*c* and 8*d*. The potential difference between the first and second deflection electrodes 8*c* and 8*d* is smaller than that between the cathode 1513 and the anode target 1515.

In this way, thermally induced electrons collide with the anode target 1515 located away from the rotating axis in the direction (radius direction) perpendicular to of the rotating axis. According to this embodiment, thermally induced electrons are deflected in the second direction d2 by the electric field E to collide with the anode target 1515.

As described above, one embodiment of the invention is applied to the X-ray tube assembly. In this way, the heat dissipation characteristics is improved by means of the water-based cooling medium. Thus, stable characteristics are secured for the long term. This serves to extend the lifetime of an X-ray image diagnostic apparatus and a non-destructive tester into which the X-ray tube assembly is built. According to the invention, a cooling medium having high cooling efficiency is usable without considering high-voltage insulation characteristics of the cooling liquid; therefore, cooling efficiency is improved. Moreover, according to the invention, the lifetime of the X-ray tube assembly itself is extended. Therefore, it is possible to reduce running costs of the foregoing X-ray image diagnostic apparatus and non-destructive tester.

The present invention is not limited to the foregoing any embodiments. Constitute components are modified and embodied within the scope diverging from the subject matter in the inventive step. A plurality of components disclosed the foregoing embodiments are properly combined, and thereby, various inventions are formed. For example, some components may be deleted from all components disclosed in the embodiments. Components disclosed in different embodiments may be properly combined.

The cooling medium 7 is not limited to water-based coolant, and insulating oil or a gas such as air may be used. The following members may be used as the bearing member. For example, in addition to roll bearing such as a ball bearing, a sliding bearing and a magnetic bearing are usable. The stationary portion 51 is directly fixed to the housing via an insulating member. However, an elastic member, an anti-vibration member or an absorption member may be interposed between the insulating member and the housing or between the insulating member and the stationary portion 51. In this way, vibration of the X-ray tube apparatus generated by rotation of the rotating body is reduced.

What is claimed is:

1. A rotating anode X-ray tube assembly comprising:

a vacuum envelope integrated with an anode target;

a housing receiving and rotatably holding the vacuum envelope;

a circulation path circulating a cooling medium in a state of closing to at least anode target of the vacuum envelope;

a cathode received and arranged in the vacuum envelope;

a cathode support member that supports the cathode in such a manner that the cathode is stationary and prevented from rotating relative to the housing;

a bearing mechanism and a vacuum sealing mechanism interposed between the vacuum envelope, and the housing or a stationary member direct or indirectly fixed to the housing; and a driver unit for rotating the vacuum envelope, wherein the vacuum envelope and the anode target are rotated relative to the cathode.

2. The assembly according to claim 1, wherein the vacuum sealing mechanism includes a magnetic fluid vacuum sealing member.

3. The assembly according to claim 1, wherein the cooling medium passes through a heat exchanger, and is circulated between the housing and the vacuum envelope by a circulating pump.

4. The assembly according to claim 1, wherein the cooling medium previously contains an inert gas solute in a saturation state, and contacts with the inert gas between the housing and the vacuum envelope.

5. The assembly according to claim 1, wherein the cooling medium is a water-based cooling medium consisting of water as a main component.

6. The assembly according to claim 5, wherein the water-based cooling medium has an electric conductivity of less than 1 mS/m.

7. The assembly according to claim 1, wherein the vacuum envelope or a member provided integrally with the vacuum envelope, and the housing or another member provided integrally with the housing form a narrow clearance between the vacuum envelope or the member, and the housing or another member to prevent the cooling medium circulating between the vacuum envelope and the housing from coming into, the vacuum envelope.

8. The assembly according to claim 1, further comprising:

a vibration absorption mechanism interposed between the cathode support member and the vacuum envelope.

9. The assembly according to claim 1, further comprising:

an intermediate rotary cylinder interposed between the cathode support member and the vacuum envelope; and a second bearing mechanism and a second vacuum sealing member each provided between the cathode support member and the intermediate cylinder, and between the intermediate cylinder and the vacuum envelope.

10. The assembly according to claim 9, further comprising:

a driver unit for rotating the intermediate cylinder.

11. The assembly according to claim 1, wherein the driver unit is a stator.

12. The assembly according to claim 9, wherein the driver unit is a stator generating a rotating magnetic field, and rotates the vacuum envelope and/or the intermediate cylinder.

13. The assembly according to claim 1, further comprising:

a removable hose joint; and a hose connected with the housing via the hose joint, and circulating the cooling medium.

14. The assembly according to claim 1, further comprising:

a getter provided in the vacuum envelope, and absorbing gases.

15. The assembly according to claim 1, further comprising:

a getter provided in the vacuum envelope, and absorbing gases; and a heater provided in the vacuum envelope, and heating the getter.

16. The assembly according to claim 1, wherein the vacuum envelope and the housing each has a window transmitting X-rays and facing the anode target in a direction perpendicular to the rotating axis.

17. The assembly according to claim 1, wherein the vacuum envelope and the housing each has a window transmitting X-rays and facing the anode target in a direction along the rotating axis.

18. The assembly according to claim 1, further comprising:

a deflector unit deflecting electrons emitted from the cathode.

19. A rotating anode X-ray tube assembly comprising:

an anode target generating X-rays by collision with electrons;

an electron emission source emitting electrons;

a vacuum container integrated with the anode target, and receiving the anode target and the electron emission source under a predetermined low pressure;

a housing receiving the vacuum container and a cooling liquid, so that a cooling liquid is circulated between the vacuum container and the housing;

a support member that fixes the electron emission source in such a manner that the electron emission source is stationary and prevented from rotating relative to the housing;

a holder member rotatably holding the vacuum container in the housing; and a vacuum sealing member positioned between the vacuum container and the holder member, so that the vacuum container is rotating in the housing while maintaining the vacuum inside the vacuum container, wherein the vacuum container and the anode target are rotated relative to the electron emission source.

20. The assembly according to claim 19, wherein the vacuum sealing member includes a magnetic fluid vacuum sealing member.

21. The assembly according to claim 19, wherein the vacuum container or a member provided integrally with the vacuum container, and the housing or a member provided integrally with the housing form a narrow clearance between them to prevent the cooling liquid circulating between the vacuum container and the housing from coming into the vacuum container.

22. The assembly according to claim 19, wherein the cooling liquid is a water-based cooling medium consisting of water as a main component.

23. The assembly according to claim 22, wherein the water-based cooling medium has an electric conductivity of less than 1 mS/m.

24. The assembly according to claim 19, wherein the vacuum envelope and the housing each has a window transmitting X-rays and facing the anode target in a direction perpendicular to the rotating axis.

25. The assembly according to claim 19, wherein the vacuum envelope and the housing each has a window transmitting X-rays and facing the anode target in a direction along the rotating axis.

26. The assembly according to claim 19, further comprising:

a deflector unit deflecting electrons emitted from the cathode.

* * * * *